US007577387B2

(12) United States Patent
Suzuki

(10) Patent No.: US 7,577,387 B2
(45) Date of Patent: Aug. 18, 2009

(54) DEVELOPING UNIT HAVING IMPROVED AGENT RECOVERY AND SUPPLY SYSTEM AND IMAGE FORMING APPARATUS USING THE SAME

(75) Inventor: Hirokatsu Suzuki, Zama (JP)

(73) Assignee: Ricoh Co., Ltd., Tokyo (JP)

( * ) Notice: Subject to any disclaimer, the term of this patent is extended or adjusted under 35 U.S.C. 154(b) by 387 days.

(21) Appl. No.: 11/493,618

(22) Filed: Jul. 27, 2006

(65) Prior Publication Data

US 2007/0025776 A1 Feb. 1, 2007

(30) Foreign Application Priority Data

Jul. 27, 2005 (JP) ..... 2005-217580

(51) Int. Cl.
*G03G 15/09* (2006.01)
*G03G 15/08* (2006.01)

(52) U.S. Cl. ..... 399/267; 399/254; 399/272; 399/277

(58) Field of Classification Search ..... 399/254, 399/256, 267, 272, 273, 277, 309
See application file for complete search history.

(56) References Cited

U.S. PATENT DOCUMENTS

| | | | | |
|---|---|---|---|---|
| 5,065,693 | A * | 11/1991 | Yoshino et al. | 399/254 X |
| 6,047,156 | A * | 4/2000 | De Bock et al. | 399/309 X |
| 6,067,433 | A * | 5/2000 | Kimura et al. | 399/277 X |
| 6,112,042 | A * | 8/2000 | Imamura et al. | 399/277 |
| 7,027,760 | B2 * | 4/2006 | Enoki | 399/267 |

FOREIGN PATENT DOCUMENTS

| | | |
|---|---|---|
| JP | 06-051634 | 2/1994 |
| JP | 11-143192 | 5/1999 |
| JP | 11-167260 | 6/1999 |
| JP | 2000-338710 | 12/2000 |
| JP | 2001-235897 | 8/2001 |
| JP | 2002-072642 | 3/2002 |
| JP | 2003-021952 | 1/2003 |
| JP | 2004-037516 | 2/2004 |

OTHER PUBLICATIONS

U.S. Appl. No. 11/940,033, filed Nov. 14, 2007, Enoki, et al.
U.S. Appl. No. 11/751,223, filed May 21, 2007, Shiraishi, et al.
U.S. Appl. No. 11/773,215, filed Jul. 3, 2007, Suzuki.

* cited by examiner

*Primary Examiner*—Sandra L Brase
(74) *Attorney, Agent, or Firm*—Oblon, Spivak, McClelland, Maier & Neustadt, P.C.

(57) ABSTRACT

A developing unit for an image forming apparatus including an agent carrying member, a supply compartment, a supply screw, a recovery compartment, a recovery screw, an agitation compartment, and an agitation screw. The agent carrying member carries and supplies developing agent to an image carrying member. The supply screw in the supply compartment supplies the developing agent to the agent carrying member. The recovery screw in the recovery compartment, provided under the agent carrying member, transports the developing agent dropped from the agent carrying member. The agitation screw in the agitation compartment receives the developing agent from the supply compartment and recovery compartment, and transports the developing agent to the supply compartment. The recovery compartment, supply compartment, and agitation compartment are provided side-by-side in a horizontal direction. A magnetic flux density in a given area of the agent carrying member is set to 10 mT or less.

12 Claims, 14 Drawing Sheets

DEVELOPING UNIT HAVING IMPROVED AGENT RECOVERY AND SUPPLY SYSTEM AND IMAGE FORMING APPARATUS USING THE SAME

BACKGROUND OF THE INVENTION

1. Technical Field of the Invention

The present disclosure generally relates to a developing unit for use in an image forming apparatus, and more particularly to an image forming apparatus including a developing unit using a two-component developer having a toner and a magnetic carrier.

2. Discussion of the Background

In general, an image forming apparatus includes a developing unit using a two-component developer (i.e., toner and magnetic carrier), for example, as shown in FIG. 1. The developing unit 5 shown in FIG. 1 includes a developing roller 5R, a delivery/recovery screw 401, and an agitation screw 11. The developing roller 5R carries a developing agent to be supplied to an image carrying member (not shown), which forms a latent image on its surface. The supply/recovery screw 401 supplies the developing agent to the developing roller 5R, and recovers the developing agent from the developing roller 5R.

The agitation screw 11 receives the developing agent from the supply/recovery screw 401 from downstream of the supply/recovery screw 401. Then the agitation screw 11 transports the developing agent in a direction opposite to a transportation direction of the supply/recovery screw 401. The agitation screw 11 also agitates the developing agent and fresh toners, which are supplied to the agitation screw 11, as required. The supply/recovery screw 401 and agitation screw 11 are arranged side-by-side in a horizontal direction as shown in FIG. 1.

As shown in FIG. 1, the supply/recovery screw 401 is provided in a supply/recovery compartment 402, and the agitation screw 11 is provided in an agitation compartment 10, where the supply/recovery compartment 402 and the agitation compartment 10 are separated by a separation wall 403. The agitation compartment 10 and the supply/recovery compartment 402 are connected to each other at both end portions of the separation wall 403, at which openings are provided in the separation wall 403 so that the developing agent can be moved through such openings. Accordingly, the developing agent can be circulated between the agitation compartment 10 and the supply/recovery compartment 402.

In the developing unit 5 shown in FIG. 1, the supply/recovery screw 401 and supply/recovery compartment 402 are used to supply the developing agent to the developing roller 5R and to recover used developing agent, where the used developing agent is an agent which is used for developing a latent image. Such used developing agent can include less amount of toner as compared to a developing agent before being used for a developing operation because some toners in the developing agent are consumed during developing of the latent image.

As shown in FIG. 1, the developing agent is supplied to the developing roller 5R and recovered from the developing roller 5R by a same screw (i.e., supply/recovery screw 401) provided in a single compartment (i.e., supply/recovery compartment 402). With such a configuration, unused developing agent and used developing agent are mixed in the supply/recovery compartment 402. Accordingly, the toner concentration in the developing agent to be supplied to the developing roller 5R may have an uneven distribution along an axial direction of the developing roller 5R. For example, the toner concentration in the developing agent may become lower from an upstream side to a downstream side of the supply/recovery screw 401.

Thus, if an image having a larger image area is developed by the developing unit 5, the toner concentration in the developing agent may significantly vary before and after a developing operation. Specifically, the toner concentration in the developing agent at the downstream side of the supply/recovery screw 401 may significantly become smaller, and thus an image quality may not be maintained at a preferable level.

Such lower toner concentration phenomenon may be prevented by increasing an amount of developing agent to be transported in the developing unit 5. However, if the amount of developing agent to be transported in the developing unit 5 is increased, the developing agent may receive a higher stress, by which a lifetime of the developing agent may become shorter.

Such a drawback may be suppressed by providing a supply screw for supplying a developing agent to a developing roller, and a recovery screw for recovering used developing agent, separately in a separate compartment. Examples of such configuration are explained below.

One such developing unit is shown in FIG. 2. A developing unit 5A shown in FIG. 2 includes a developing roller 5R, a supply screw 8, and a recovery/agitation screw 110. The supply screw 8 transports a developing agent in one direction and supplies the developing agent to the developing roller 5R. The recovery/agitation screw 110 recovers the developing agent from the developing roller 5R and transports the recovered developing agent in a direction opposite to a transport direction of the supply screw 8.

As shown in FIG. 2, the supply screw 8 is provided in a supply compartment 9, and the recovery/agitation screw 110 is provided in a recovery/agitation compartment 210, where the supply compartment 9 and recovery/agitation compartment 210 are separated by a separation wall 403. As shown in FIG. 2, the supply compartment 9 is provided over the recovery/agitation compartment 210. The supply compartment 9 and the recovery/agitation compartment 210 are connected to each other at an opening provided at both end portions of the separation wall 403.

Excessive developing agent, which is not used for developing and transported to a downstream end of the supply compartment 9, is dropped and supplied to the recovery/agitation compartment 210 from the supply compartment 9 through an opening at the downstream end of the supply compartment 9. In the recovery/agitation compartment 210, the excessive developing agent and the recovered developing agent are agitatingly transported by the recovery/agitation screw 110. At a downstream end of the recovery/agitation compartment 210, the developing agent is pushed and piled up by the recovery/agitation screw 110 so that the developing agent can be supplied to the supply compartment 9 through an opening at the downstream end of the recovery/agitation compartment 210. The recovery/agitation compartment 210 is also provided with a screw 209 as shown in FIG. 2, which is used to transport developing agent to an upstream end of the recovery/agitation compartment 210 to prevent a piling-up of too much developing agent at the downstream end of the recovery/agitation compartment 210.

In the developing unit 5A shown in FIG. 2, used developing agent is recovered in the recovery/agitation compartment 210, by which the used developing agent may not intrude in the supply compartment 9. With such configuration, the toner concentration in the developing agent in the supply compartment 9 may be maintained at a given level, and thereby the toner concentration in the developing agent to be supplied to the developing roller 5R may be maintained at a given level.

Another developing unit is shown in FIG. 3. A developing unit 5B shown in FIG. 3 includes a developing roller 5R, a supply screw 8, a recovery screw 6, and an agitation screw 11. The recovery screw 6 recovers developing agent from the developing roller 5R, and transports the recovered developing agent in a same transportation direction of the supply screw 8. Excessive developing agent, transported to a downstream end of the supply screw 8, and the recovered developing agent, transported to a downstream end of the recovery screw 6, are moved to the agitation screw 11, and then the agitation screw 11 agitatingly transports the developing agent in a direction opposite to a transport direction of the supply screw 8.

As shown in FIG. 3, the supply screw 8 is provided in a supply compartment 9, and the agitation screw 11 is provided in an agitation compartment 10, where the supply compartment 9 and agitation compartment 10 are separated by a first separation wall 404. As shown in FIG. 3, the supply compartment 9 is provided over the agitation compartment 10. The supply compartment 9 and agitation compartment 10 are connected to each other at an opening provided at both end portions of the first separation wall 404.

An excessive developing agent, which is not used for developing and transported to a downstream end of the supply compartment 9, is dropped and supplied to the agitation compartment 10 from the supply compartment 9 through an opening at a downstream end of the supply compartment 9. As shown in FIG. 3, the recovery screw 6 is provided in a recovery compartment 7, where the recovery compartment 7 and agitation compartment 10 are arranged side-by-side in a horizontal direction, and the recovery compartment 7 and agitation compartment 10 are separated by a second separation wall 405. The recovery compartment 7 and agitation compartment 10 are connected to each other at an opening provided at a downstream end of the recovery screw 6 (i.e., an end of the second separation wall 405).

Recovered developing agent is transported to the downstream end of the recovery compartment 7, and then moved to the agitation compartment 10 in a horizontal direction. In the agitation compartment 10, the agitation screw 11 agitatingly transports the developing agent. At a downstream end of the agitation compartment 10, the developing agent is pushed and piled up by the agitation screw 11 so that the developing agent can be supplied to the supply compartment 9 through an opening at the downstream end of the agitation compartment 10.

In the developing unit 5B shown in FIG. 3, used developing agent is recovered in the recovery compartment 7, by which the used developing agent may not intrude in the supply compartment 9. With such a configuration, the toner concentration in the developing agent in the supply compartment 9 may be maintained at a given level, and thereby the toner concentration in the developing agent to be supplied to the developing roller 5R may be maintained at a given level.

Another developing unit is shown in FIG. 4. A developing unit 5C shown in FIG. 4 includes a developing roller 5R, a supply screw 440, a transport screw 450, a recovery screw 6, and an agitation screw 11. The supply screw 440 transports and supplies a developing agent to the developing roller 5R. The transport screw 450, provided in a parallel position of the supply screw 440, transports the developing agent in a same transportation direction of the supply screw 440. Developing agent not used for developing operation is transported to a downstream end of the supply screw 440 and transport screw 450 as excessive developing agent.

The recovery screw 6, provided over the transport screw 450, recovers the developing agent from an upper side of the developing roller 5R, and transports the recovered developing agent in a same transportation direction of the supply screw 440 and transport screw 450. The agitation screw 11, provided next to the transport screw 450, receives the excessive developing agent and recovered developing agent transported to the downstream end of the recovery screw 6. Then, the agitation screw 11 agitatingly transports the developing agent in an opposite transportation direction of the supply screw 440 and transport screw 450.

As shown in FIG. 4, the supply screw 440, transport screw 450, and agitation screw 11 are arranged in a substantially horizontal direction. The supply screw 440 and transport screw 450 are provided in a supply compartment 9, and the agitation screw 11 is provided in an agitation compartment 10, where the supply compartment 9 and agitation compartment 10 are separated by a first separation wall 404. The supply compartment 9 and agitation compartment 10 are connected to each other at an opening provided at both ends of the first separation wall 404. The excessive developing agent, not used for developing operation, is transported to a downstream end of the supply compartment 9, and then moved in a horizontal direction through the opening at the downstream end of the supply compartment 9, and supplied into the agitation compartment 10.

The recovery screw 6 is provided in a recovery compartment 7, which is provided over the supply compartment 9. The recovery compartment 7 and supply compartment 9 are separated by a second separation wall 405. The second separation wall 405 has an opening at a downstream end of the recovery screw 6 (i.e., downstream end of the recovery compartment 7). The downstream end of the recovery compartment 7 is connected to the agitation compartment 10 via the downstream end of the supply compartment 9.

Recovered developing agent, transported to the downstream end of the recovery compartment 7, drops into the supply compartment 9 through the opening of the second separation wall 405, and then is supplied to the agitation compartment 10 with the excessive developing agent. The excessive developing agent and recovered developing agent supplied in the agitation compartment 10 are agitatingly transported by the agitation screw 11, and moved into a horizontal direction through the opening at a downstream end of the agitation compartment 10, and supplied into an upstream of the supply compartment 9.

In the developing unit 5C shown in FIG. 4, the developing agent used for developing operation is recovered in the recovery compartment 7, by which an intrusion of the used developing agent into the supply compartment 9 can be suppressed. Accordingly, compared to the developing unit 5 shown in FIG. 1, the developing unit 5C shown in FIG. 4 may reduce a variation of toner concentration in the developing agent to be supplied to the developing roller 5R.

In the developing unit 5A shown in FIG. 2, the recovery/agitation compartment 210 is used for recovering and agitation of the developing agent. With such configuration shown in FIG. 2, the developing agent recovered from the developing roller 5R may drop into the recovery/agitation compartment 210 while the recovery/agitation screw 110 is conducting an agitation of the developing agent. In such condition, developing agent, not effectively agitated by the recovery/agitation screw 110, may be supplied to supply compartment 9 from the recovery/agitation compartment 210 because some developing agent may drop from the developing roller 5R in the downstream side of the recovery/agitation compartment 210, where the developing agent dropped in the downstream side of the recovery/agitation compartment 210 may not be effectively agitated. If such developing agent is supplied to the supply compartment 9, a toner concentration in the developing agent in the supply compartment 9 may become lower or may show an uneven concentration distribution. Such phenomenon may become more serious when an image having a larger image area is produced by an image forming apparatus because the larger image area may consume more toner in the developing agent in general.

In the developing unit 5A, the supply compartment 9 is provided over the recovery/agitation compartment 210 to reduce a space volume of the developing unit 5A in a horizontal direction. The developing agent can be moved from the recovery/agitation compartment 210 to the supply compartment 9 as below: the developing agent is accumulated at the downstream of the recovery/agitation compartment 210; and then the recovery/agitation screw 110 pushes and piles up the developing agent. Accordingly, the developing agent is pushed in an upward direction to supply the developing agent from the recovery/agitation compartment 210 to the supply compartment 9, by which the developing agent may receive a larger stress, and may shorten its lifetime due to such stress.

In the developing unit 5B shown in FIG. 3, a recovery of developing agent and an agitation of developing agent are separately conducted in the recovery compartment 7 and agitation compartment 10. With such configuration, developing agent not agitated effectively may not be supplied to the supply compartment 9, by which a toner concentration in the developing agent in the supply compartment 9 may not become lower or may not show an uneven concentration distribution. However, because the supply compartment 9 is provided over the agitation compartment 10, the developing agent is pushed in an upward direction to supply the developing agent from the agitation compartment 10 to the supply compartment 9, by which the developing agent may receive a larger stress, and may shorten its lifetime due to such stress as similar to the developing unit 5A shown in FIG. 2.

In the developing unit 5C shown in FIG. 4, a recovery of developing agent and an agitation of developing agent are separately conducted in the recovery compartment 7 and agitation compartment 10. With such configuration, as similar to the developing unit 5B shown in FIG. 3, developing agent not agitated effectively may not be supplied to supply compartment 9, by which a toner concentration in the developing agent in the supply compartment 9 may not become lower or may not show an uneven concentration distribution. Furthermore, because the supply compartment 9 and agitation compartment 10 are arranged in a substantially horizontal direction, the developing agent is not supplied to an upward direction when circulating the developing agent in the developing unit 5C, by which the developing agent may not receive a larger stress, and may not shorten its lifetime.

However, in the developing unit 5C, used developing agent is recovered from an upper side the developing roller 5R in the recovery compartment 7 as shown in FIG. 4. Specifically, developing agent is recovered from a surface of the developing roller 5R, which faces upward in FIG. 4. Therefore, some used developing agent may remain on the developing roller 5R even if a magnetic force on the developing roller 5R may not effect to the developing agent. Such developing agent remained on the developing roller 5R may be transported with a rotation of the developing roller 5R, and may drop into the supply compartment 9. If the used developing agent intrudes the supply compartment 9, a toner concentration in the developing agent in the supply compartment 9 may become lower or may show an uneven concentration distribution.

SUMMARY OF THE INVENTION

The present disclosure relates to a developing unit for use in an image forming apparatus including an image carrying member. The developing unit includes an agent carrying member, a supply compartment, a supply screw, a recovery compartment, a recovery screw, an agitation compartment, and an agitation screw. The agent carrying member carries a two-component developer having a magnetic carrier and a toner, and rotates to supply the toner to a latent image formed on the image carrying member at a position where the agent carrying member faces the image carrying member. The agent carrying member includes a plurality of magnets therein to generate a magnetic flux density over the agent carrying member. The supply compartment is used to transport the developing agent to be supplied to the agent carrying member. The supply screw, included in the supply compartment, supplies the developing agent to the agent carrying member while transporting the developing agent in a longitudinal direction of the supply compartment. The recovery compartment, provided under the agent carrying member, recovers the developing agent dropped from the agent carrying member after the toner is supplied to the image carrying member from the agent carrying member. The recovery screw, included in the recovery compartment, transports the recovered developing agent in a longitudinal direction of the recovery compartment. The recovery screw and supply screw transport the developing agent in a same direction. The agitation compartment receives the developing agent from the supply compartment, which is not supplied to the agent carrying member for developing operation and transported to a most downstream portion of the supply compartment, and the recovered developing agent from the recovery compartment, which is transported to a most downstream portion of the recovery compartment. The agitation screw, included in the agitation compartment, agitatingly transports the developing agent in a longitudinal direction of the agitation compartment to supply agitated developing agent to the supply compartment. The agitation screw and supply screw transport the developing agent in directions opposite to each other. The recovery compartment, supply compartment, and agitation compartment are provided side-by-side in a substantially horizontal direction, and the magnetic flux density on a surface of the agent carrying member in a normal line direction, extended from a center of the agent carrying member to a center of the recovery screw, is set to 10 mT or less.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF PREFERRED EMBODIMENTS

Figure 1:
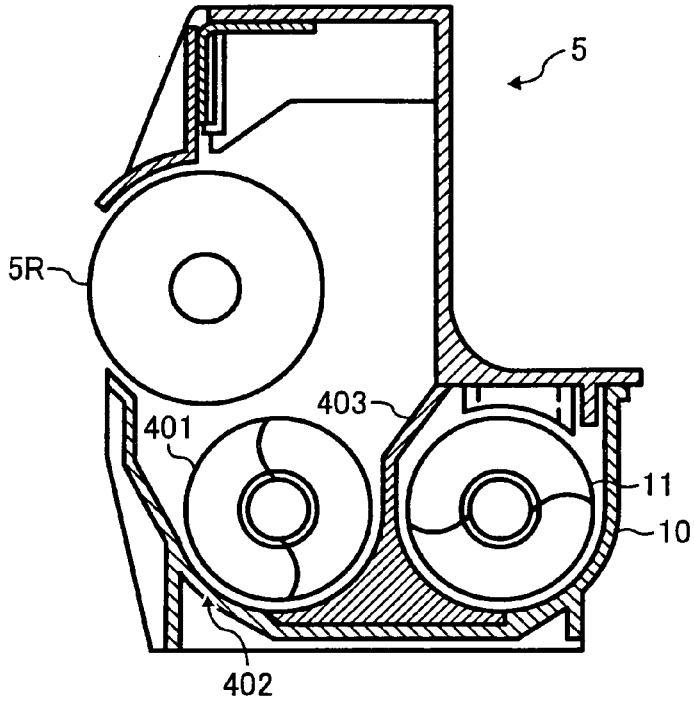
FIG. 1 PRIOR ART
FIG. 1 is a schematic configuration of a conventional developing unit.

In describing the exemplary embodiments shown in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, where like reference numerals designate identical or corresponding parts throughout the several views, an image forming apparatus according to an exemplary embodiment is described with reference to FIG. 5.

Figure 5:
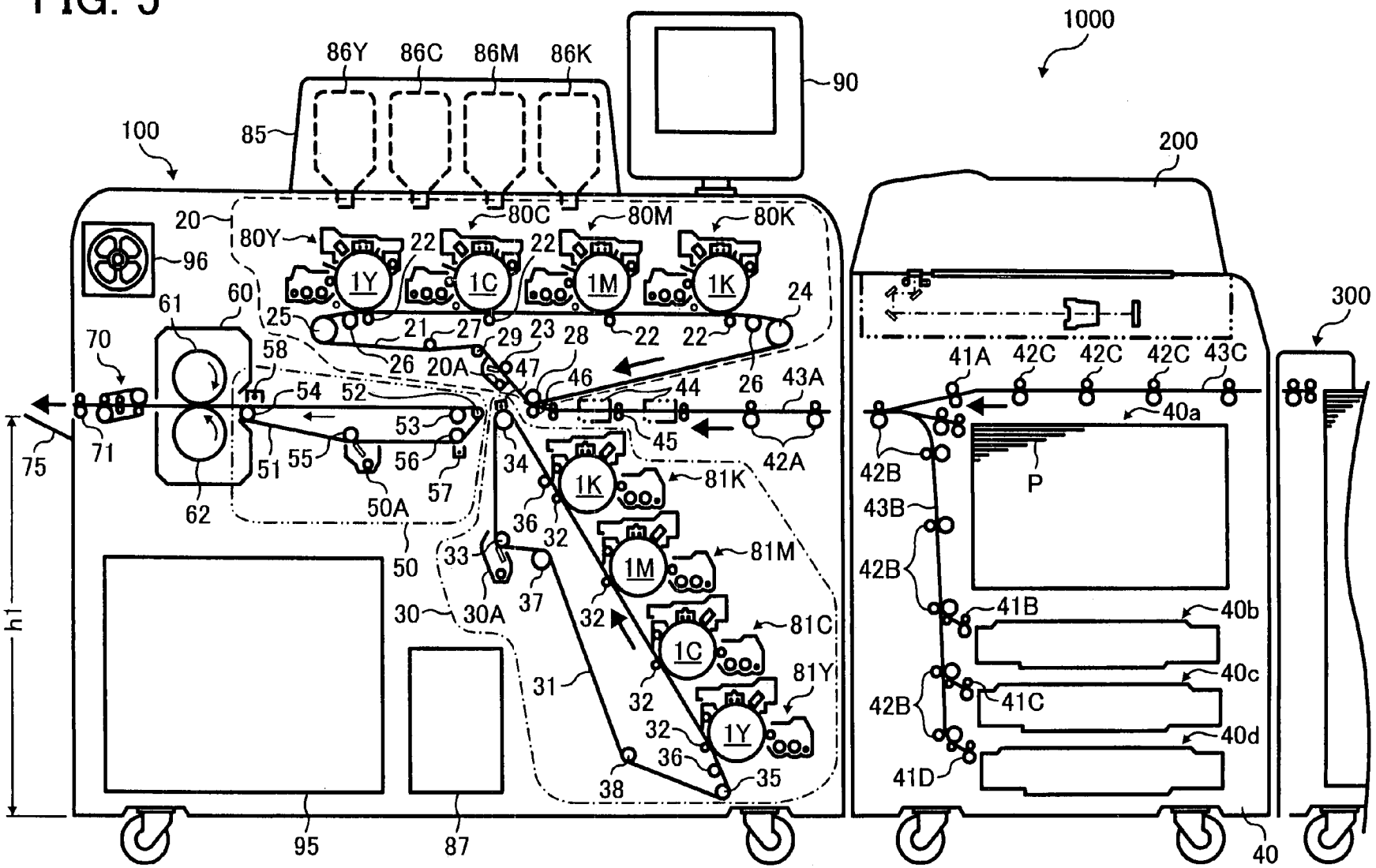
FIG. 5 is a schematic configuration of an image forming apparatus having a developing unit according to an exemplary embodiment.

FIG. 5 is a schematic configuration of an image forming apparatus 1000 according to an exemplary embodiment, where the image forming apparatus 1000 can be used as color image forming apparatus using electro photography, for example.

The image forming apparatus 1000 includes a printing unit 100, an operation/display unit 90, a sheet feed unit 40, an automatic document feeder 200, and an annex sheet feed unit 300 as illustrated in FIG. 5. The printing unit 100 includes a first image forming section 20, a second image forming section 30, a sheet feed route 43A, and a controller 95 as illustrated in FIG. 5. The first image forming section 20 is disposed over the sheet feed route 43A, and the second image forming section 30 is disposed under the sheet feed route 43A.

The first image forming section 20 includes a first intermediate transfer belt 21, configured to be traveled in a direction shown by an arrow in FIG. 5. The first intermediate transfer belt 21 includes an endless type belt as illustrated in FIG. 5. The second image forming section 30 includes a second intermediate transfer belt 31, configured to be traveled in a direction shown by an arrow in FIG. 5. The second intermediate transfer belt 31 includes an endless type belt as illustrated in FIG. 5.

As illustrated in FIG. 5, first process units 80Y, 80M, 80C, and 80K are disposed above the first intermediate transfer belt 21, where the first process units 80Y, 80M, 80C, and 80K are used for toner image forming. As also illustrated in FIG. 5, second process units 81Y, 81M, 81C, and 81K are disposed to a side portion of the second intermediate transfer belt 31, where the second process units 81Y, 81M, 81C, and 81K are used for toner image forming.

Hereinafter, reference characters "Y, M, C, and K" indicate color of "yellow, magenta, cyan, and black," respectively.

Each of the process units (i.e., 80Y, 80M, 80C, 80K, 81Y, 81M, 81C, 81K) includes a photosensitive member (i.e., 1Y, 1M, 1C, 1K) serving as image carrying member. The first process units 80Y, 80M, 80C, and 80K include the photosensitive members 1Y, 1M, 1C, and 1K, respectively, where the photosensitive members 1Y, 1M, 1C, and 1K are arranged at equal intervals, and can be contacted to an outer surface of the first intermediate transfer belt 21 when conducting an image forming. Hereinafter, the outer surface of the first intermediate transfer belt 21 is referred as first image receiving belt-surface.

The second process units 81Y, 81M, 81C, and 81K include the photosensitive members 1Y, 1M, 1C, and 1K, respectively, where the photosensitive members 1Y, 1M, 1C, and 1K are arranged at equal intervals, and can be contacted to an outer surface of the second intermediate transfer belt 31 when conducting an image forming. Hereinafter, the outer surface of the second intermediate transfer belt 31 is referred as second image receiving belt-surface.

As illustrated in FIG. 5, the first intermediate transfer belt 21 is extended by a plurality of rollers in a substantially horizontal direction, thereby the first image receiving belt-surface substantially extends in a horizontal direction as illustrated in FIG. 5. Accordingly, the first intermediate transfer belt 21 occupies a space in the printing unit 100 in a horizontal direction. The first process units 80Y, 80M, 80C, and 80K are arranged in a tandem manner above the first image receiving belt-surface of the first intermediate transfer belt 21 as illustrated in FIG. 5.

The second intermediate transfer belt 31 is extended by a plurality of rollers, where the second intermediate transfer belt 31 is extended from a bottom right to an upper left as illustrated in FIG. 5. As illustrated in FIG. 5, a right side portion of the second intermediate transfer belt 31 extends in a downward direction. The second process units 81Y, 81M, 81C, and 81K are arranged in a tandem manner along the right side portion (i.e., second image receiving belt-surface) of the second intermediate transfer belt 31, thereby the second process units 81Y, 81M, 81C, and 81K are arranged in a stepwise manner in a substantially vertical direction as illustrated in FIG. 5.

Figure 6:
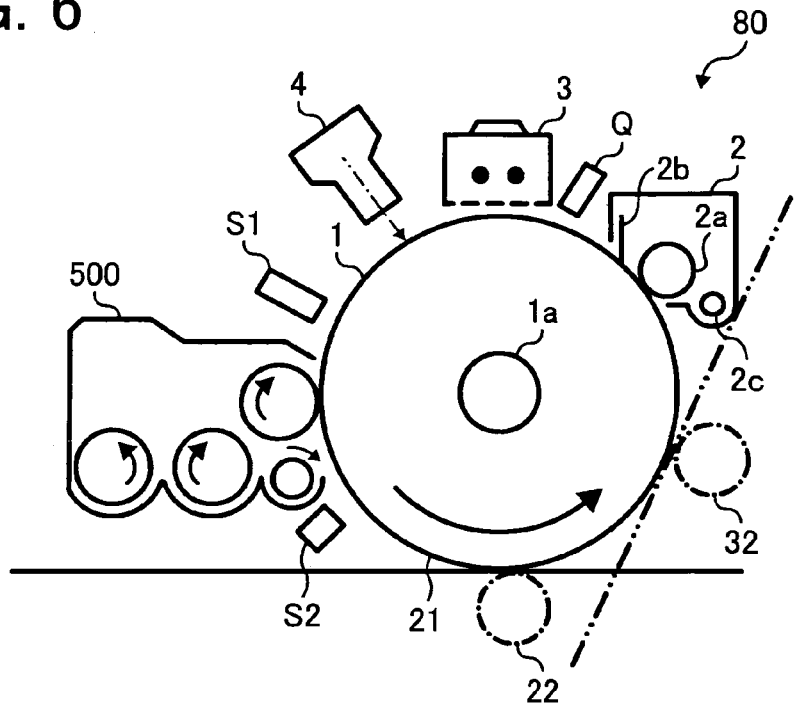
FIG. 6 is a schematic expanded view of a first process unit in a printing unit of the image forming apparatus in FIG. 5.

FIG. 6 is a schematic expanded view of a process unit of the first process units 80Y, 80M, 80C, and 80K in the printing unit 100 of the image forming apparatus 1000. Because the first process units 80Y, 80M, 80C, and 80K have a same configuration as one another, except for the color of the toner, reference characters "Y, M, C, and K" are omitted from FIG. 6.

As illustrated in FIG. 6, the photosensitive member 1 is driven in a counter-clockwise direction by a drive unit (not shown) when the printing unit 100 is operated for image forming. As illustrated in FIG. 6, the photosensitive member 1 is surrounded by a scorotron charger 3, an optical writing unit 4, a developing unit 500, a cleaning unit 2, a de-charging unit Q, an electric potential sensor S1, and an image sensor S2, for example.

The photosensitive member 1 can be formed in a drum shape. For example, the photosensitive member 1 can be made of an aluminum cylinder having a diameter of 30 to 120 mm, and a photoconductivity material such as organic photo conductor (OPC) and amorphous silicon (a-Si) is coated on the cylinder.

Although not shown, the photosensitive member 1 can also be formed in a belt shape.

As illustrated in FIG. 6, the cleaning unit 2 includes a cleaning brush 2*a*, a cleaning blade 2*b*, and a collector 2*c*. The cleaning unit 2 removes and collects toner remaining on the photosensitive member 1 after a toner image is transferred to the first intermediate transfer belt 21 from the photosensitive member 1 at a primary transfer nip (to be described later).

The scorotron charger 3 uniformly charges a surface of the photosensitive member 1 to a negative potential, for example. Instead of the scorotron charger 3, a corotron charger can be used to uniformly charge a surface of the photosensitive member 1. Furthermore, instead of the scorotron charger 3, a charge biasing member (not shown) having applied with charge bias can be contacted to the surface of the photosensitive member 1, for example.

The optical writing unit 4 scans the charged surface of the photosensitive member 1 with a light beam, generated based on image data for each color, to form an electrostatic latent image on the surface of the photosensitive member 1. The optical writing unit 4 includes a LED (light emitting diode) array and a focusing element, for example. The optical writing unit 4 can also include a laser type unit, which includes a laser beam source, a polygon mirror and other components to generate a modulated laser beam based on image data.

In the printing unit 100, an image is developed by a two-component developing agent including toner and carrier. The photosensitive member 1, charged in a negative potential, forms an electrostatic latent image for each color on the photosensitive member 1 by irradiating a laser beam for each color to the photosensitive member 1. Each electrostatic latent image for each color is developed by toner having a same polarity of the charged photosensitive member 1.

The developing unit 500 will be explained in detail later.

Figure 7:
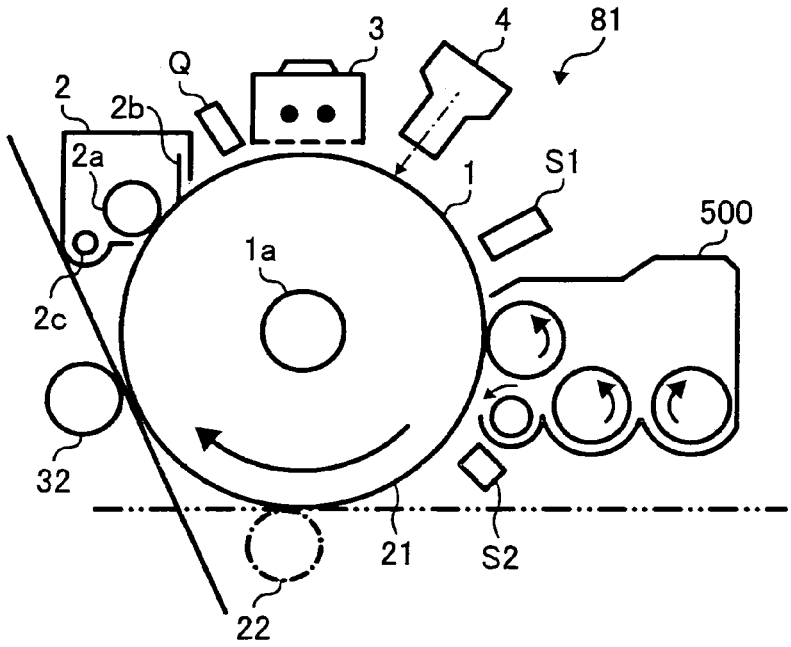
FIG. 7 is a schematic expanded view of a second process unit in a printing unit of the image forming apparatus in FIG. 5.

FIG. 7 is a schematic expanded view of a process unit of second process units 81Y, 81M, 81C, and 81K in the printing unit 100 of the image forming apparatus 1000.

The second process units 81Y, 81M, 81C, and 81K have a same configuration as one another, except for the color of toner. Furthermore, the second process units 81Y, 81M, 81C, and 81K and the first process units 80Y, 80M, 80C, and 80K have a same configuration as one another, except for a rotation direction of the photosensitive member 1, where the photosensitive member 1 in the second process units 81Y, 81M, 81C, and 81K rotate in an opposite direction as compared to the photosensitive member 1 in the first process units 80Y, 80M, 80C, and 80K.

Figure 2:
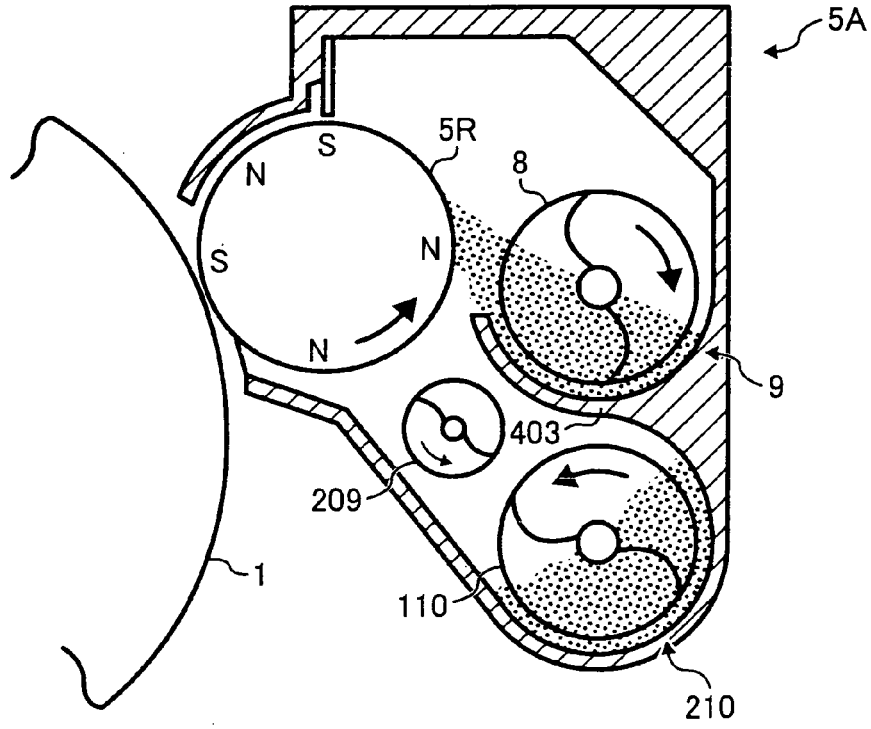
FIG. 2 PRIOR ART
FIG. 2 is a schematic configuration of a related art developing unit.
Figure 3:
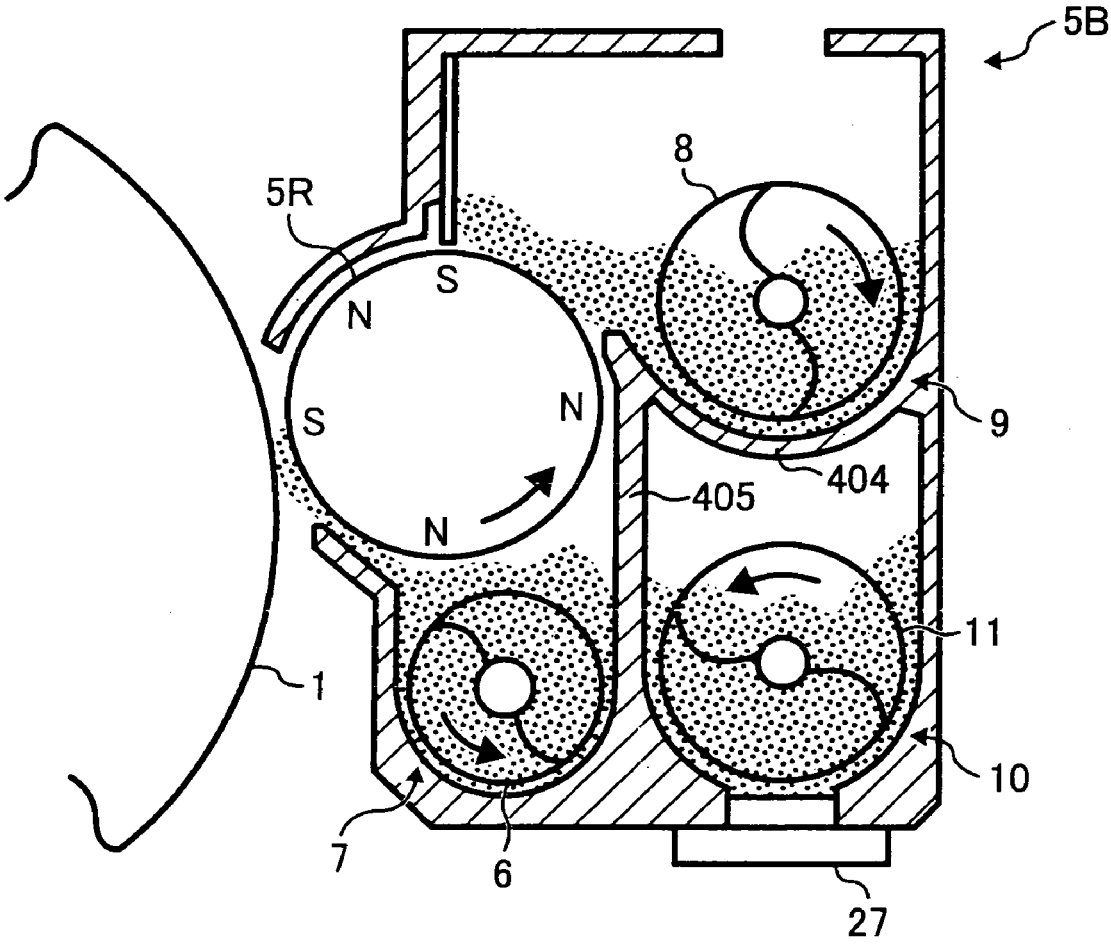
FIG. 3 PRIOR ART
FIG. 3 is a schematic configuration of another related art developing unit.
Figure 4:
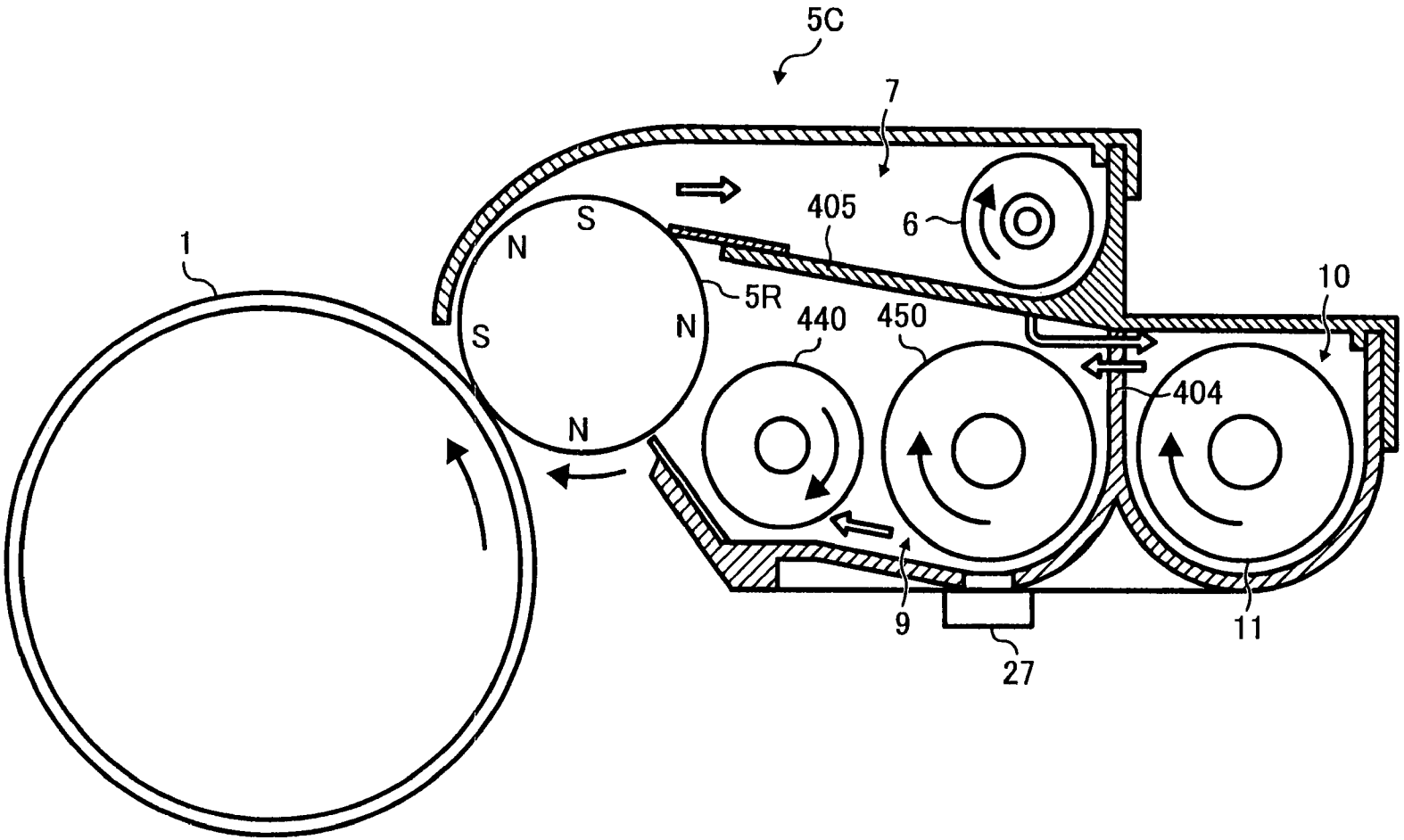
FIG. 4 PRIOR ART
FIG. 4 is a schematic configuration of a further related art developing unit.

The first process units 80Y, 80M, 80C, and 80K and the second process units 81Y, 81M, 81C, and 81K have a symmetrical configuration to each other as illustrated in FIGS. 2 and 3. Such a symmetrical configuration has preferable aspects. For example, such a symmetrical configuration is preferable by considering a design layout for connecting the process units 80 and 81 with other units in the printing unit 100 such as a drive unit, an electrical unit, a toner supply unit, and a toner ejection unit.

Furthermore, the first process units 80Y, 80M, 80C, and 80K and the second process units 81Y, 81M, 81C, and 81K can be made as interchangeable units because of such a symmetrical configuration. Accordingly, the first process units 80Y, 80M, 80C, and 80K and the second process units 81Y, 81M, 81C, and 81K can use common parts for the developing unit 500, cleaning unit 2 and other units, thereby unique parts are not required for each of the first process units 80Y, 80M, 80C, and 80K and the second process units 81Y, 81M, 81C, and 81K. Therefore, a manufacturer can streamline parts management and manufacturing works, by which an overall manufacturing cost of an image forming apparatus can be reduced.

As illustrated in FIG. 5, the printing unit 100 includes the first image forming section 20 and the second image forming section 30. With the first image forming section 20 and the second image forming section 30, an image can be formed on each face of one recording medium.

In the first image forming section 20, the first intermediate transfer belt 21 is extended by a plurality of rollers 22, 23, 24, 25, 26, 27, 28, and 29. The first intermediate transfer belt 21 can contact the photosensitive members 1Y, 1M, 1C, and 1K of the respective first process units 80Y, 80M, 80C, and 80K. Such contact points of the first intermediate transfer belt 21 and the photosensitive members 1Y, 1M, 1C, and 1K are defined as primary transfer nips formed between the first intermediate transfer belt 21 and the photosensitive members 1Y, 1M, 1C, and 1K. At such primary transfer nips, Y, M, C, and K toner image on the respective photosensitive members 1Y, 1M, 1C, and 1K are super-imposingly transferred to the first intermediate transfer belt 21.

The first intermediate transfer belt 21 of endless type belt travels in a clockwise direction as shown by an arrow in FIG. 5. At each primary transfer nip, a primary transfer roller 22 and the photosensitive members 1Y, 1M, 1C, and 1K sandwich the first intermediate transfer belt 21, where the primary transfer roller 22 is applied with a primary transfer bias voltage by a power source (not shown). With an effect of the primary transfer bias voltage and nip pressure, Y, M, C, and K toner image on the respective photosensitive members 1Y, 1M, 1C, and 1K are super-imposingly transferred to the first intermediate transfer belt 21 at each primary transfer nip.

As illustrated in FIG. 5, a cleaning unit 20A is provided at a position which faces the roller 23 by sandwiching the first intermediate transfer belt 21 between the cleaning unit 20A and the roller 23. The cleaning unit 20A removes foreign objects such as paper powder and toners remaining on the first intermediate transfer belt 21 after transferring a toner image to the transfer sheet P at the secondary transfer nip, defined by the secondary transfer roller 46 and support roller 28.

The first intermediate transfer belt 21 and relating parts are integrated in the first image forming section 20, thereby the first image forming section 20 is detachable from the printing unit 100 as one unit.

In the second image forming section 30, the second intermediate transfer belt 31 is extended by a plurality of rollers 32, 33, 34, 35, 36, 37, and 38. The second intermediate transfer belt 31 can contact the photosensitive members 1Y, 1M, 1C, and 1K of the respective second process units 81Y, 81M, 81C, and 81K. Such contact points of the second intermediate transfer belt 31 and the photosensitive members 1Y, 1M, 1C, and 1K are defined as primary transfer nips formed between the second intermediate transfer belt 31 and the photosensitive members 1Y, 1M, 1C, and 1K. At such primary transfer nips, Y, M, C, and K toner image on the respective photosensitive members 1Y, 1M, 1C, and 1K are superimposingly transferred to the second intermediate transfer belt 31.

The second intermediate transfer belt 31 of endless type belt travels in a counter-clockwise direction as shown by an arrow in FIG. 5. At each primary transfer nip, a primary transfer roller 32 and the photosensitive members 1Y, 1M, 1C, and 1K sandwich the second intermediate transfer belt 31, where the primary transfer roller 32 is applied with a primary transfer bias voltage by a power source (not shown). With an effect of the primary transfer bias voltage and nip pressure, Y, M, C, and K toner image on the respective photosensitive members 1Y, 1M, 1C, and 1K are super-imposingly transferred to the second intermediate transfer belt 31 at each primary transfer nip.

As illustrated in FIG. 5, a cleaning unit 30A is provided at a position that faces the roller 33 by sandwiching the second intermediate transfer belt 31 between the cleaning unit 30A and the roller 33. The cleaning unit 30A removes foreign objects such as paper powder and toners remaining on the second intermediate transfer belt 31 after transferring a toner image to the transfer sheet P at the secondary transfer nip, defined by a transfer charger 47 and support roller 34.

The second intermediate transfer belt 31 and relating parts are integrated in the second image forming section 30, thereby the second image forming section 30 is detachable from the printing unit 100 as one unit.

Each of the first intermediate transfer belt 21 and second intermediate transfer belt 31 includes a base layer made of material such as resin film and rubber having a thickness of 50 to 600 μm, for example. Such intermediate transfer belts (i.e., first intermediate transfer belt 21 and second intermediate transfer belt 31) each have an electric resistance value that enables a transfer of toner image from the photosensitive member 1 to the surface of the intermediate transfer belt electro-statistically with an effect of a primary transfer bias voltage applied by the primary transfer roller 22 or 32. For example, such intermediate transfer belts can be made by dispersing carbons in polyamide and adjusting a volume electric resistance value in a range of $10^6$ to $10^{12}$ Ω·cm.

Furthermore, each of the first intermediate transfer belt 21 and the second intermediate transfer belt 31 includes a belt-aligning rib at one lateral side of the belt or both lateral sides of the belt, where the belt-aligning rib is used for stabilizing a traveling direction of the belt. The intermediate transfer belt has a circumferential length of approximately 1,500 mm, for example.

The primary rollers 22 and 32 include the following structure, for example. Specifically, the primary rollers 22 and 32 each include a core and an electro-conductive layer coated on the core. The core is made of a metal and the electro-conductive layer includes rubber material. The core is applied with a primary bias voltage from a power source (not shown). In an exemplary embodiment, the electro-conductive layer can be made by dispersing carbons in urethane rubber and adjusting a volume electric resistance value to approximately $10^5$ Ω·cm.

The printing unit 100 can also produce a monochrome image by using only black toner. In case of producing a monochrome image, the process units 80Y, 80M, and 80C in the first image forming section 20 are not used. The printing unit 100 includes a mechanism (not shown) to maintain a non-contact condition between the process units 80Y, 80M, and 80C and the first intermediate transfer belt 21 when producing a monochrome image and stopping an operation of the process units 80Y, 80M, and 80C. For example, such a mechanism includes an internal frame (not shown), which can move in a pivotable manner while supporting the roller 26 and the primary roller 22. By such pivoting of the internal frame, the first intermediate transfer belt 21 is disengaged from the photosensitive members 1Y, 1M, and 1C, and is contacted only to the photosensitive member 1K. Then, the image forming apparatus 1000 can produce a monochrome image using black toner. Such a mechanism is preferable to prolong a lifetime of the photosensitive members.

Similarly, the second image forming section 30 also includes such a mechanism to maintain a non-contact condition of the process units 81Y, 81M, and 81C and the second intermediate transfer belt 31 when the image forming apparatus 1000 produces a monochrome image.

As illustrated in FIG. 5, a secondary transfer roller 46 is provided near the support roller 28 and an outer face of the first intermediate transfer belt 21. As illustrated in FIG. 5, the secondary transfer roller 46 and the support roller 28 sandwich the first intermediate transfer belt 21 therebetween to form a secondary transfer nip. Specifically, the secondary transfer roller 46 includes a core and an electro-conductive layer coated on the core. The core is made of a metal and the electro-conductive layer includes rubber material. The core is applied with a secondary bias voltage from a power source (not shown). In an exemplary embodiment, the electro-conductive layer can be made by dispersing carbons in rubber and adjusting a volume electric resistance value to approximately $10^7$ Ω·cm.

As illustrated in FIG. 5, a pair of registration rollers 45 is provided in a rightward direction of the secondary transfer nip, defined by the secondary transfer roller 46 and the support roller 28. The pair of registration rollers 45 sandwiches a transfer sheet P transported from the sheet feed unit 40 (to be described later), and stops the rotation of the registration rollers 45 temporarily. Then, the pair of registration rollers 45 feed the transfer sheet P to the secondary transfer nip, defined by the secondary transfer roller 46 and the support roller 28, by synchronizing a feed timing with a traveling speed of the first intermediate transfer belt 21 having a four-color toner image thereon.

The transfer sheet P has first and second faces, which are opposite sides of the transfer sheet P. In FIG. 5, the first face of the transfer sheet P faces the upward and receives the four-color toner image from the first intermediate transfer belt 21 at the secondary transfer nip, defined by the secondary transfer roller 46 and the support roller 28. At the secondary transfer nip, the secondary transfer roller 46 applies a positive electric charge as a secondary transfer bias voltage, which is opposite to the negatively charged toner. With an effect of the secondary transfer bias voltage and nip pressure, the four-color toner image is transferred from the first intermediate transfer belt 21 to the first face of the transfer sheet P, and then the transfer sheet P passes through the secondary transfer nip, defined by the secondary transfer roller 46 and the support roller 28. The transfer sheet P passed through the secondary transfer nip leaves the first image forming section 20, and moves onto the second intermediate transfer belt 31 in the second image forming section 30.

As illustrated in FIG. 5, the second intermediate transfer belt 31 includes an upper extended portion, which is extended by the support roller 34. As illustrated in FIG. 5, a transfer charger 47 is provided over the upper extended portion of the second intermediate transfer belt 31 with a given gap therebetween. As illustrated in FIG. 5, the transfer charger 47 and the upper extended portion of the second intermediate transfer belt 31 define a secondary transfer nip, which is used for transferring a four-color toner image from the second intermediate transfer belt 31 to the second face of the transfer sheet P. As above-mentioned, the second face of the transfer sheet P is opposite side of the first face of the transfer sheet P and faces the downward in FIG. 5.

The transfer charger 47 includes a discharge electrode (e.g., tungsten and gold thin wire) and a casing for holding the discharge electrode, where the discharge electrode is applied with a secondary transfer voltage from a power source (not shown). When the transfer sheet P passes through the secondary transfer nip, defined by the transfer charger 47 and the second intermediate transfer belt 31, the transfer sheet P is applied with an electric charge from the transfer charger 47 to transfer the four-color toner image from the second intermediate transfer belt 31 to the second face of the transfer sheet P. The transfer charger 47 applies a positive electric charge as secondary transfer bias voltage, which is opposite to the negatively charged toner, at the secondary transfer nip, defined by the transfer charger 47.

The transfer charger 47 does not contact the surface of the transfer sheet P. Specifically, the transfer charger 47 does not contact the first face of the transfer sheet P. If the transfer charger 47 contacts the transfer sheet P, the four-color toner image transferred on the first face of the transfer sheet P may be disturbed by the transfer charger 47. Accordingly, the transfer charger 47 is provided above the second intermediate transfer belt 31 by setting a given gap between the second intermediate transfer belt 31 and the transfer charger 47.

As illustrated in FIG. 5, the sheet feed unit 40 is provided next to the printing unit 100. The sheet feed unit 40 stores recording medium such as transfer sheet and supplies recording medium to the printing unit 100. As illustrated in FIG. 1, the sheet feed unit 40 includes sheet feed trays 40*a*, 40*b*, 40*c*, and 40*d*, for example. The sheet feed tray 40*a* can store a large capacity of transfer sheets compared to the other sheet feed trays 40*b*, 40*c*, and 40*d*, for example. Each of the sheet feed trays 40*a*, 40*b*, 40*c*, and 40*d* is configured to be withdrawable from the sheet feed unit 40. The sheet feed trays 40*a*, 40*b*, 40*c*, and 40*d* can store different types of transfer sheets therein.

An upper most transfer sheet in the sheet feed trays 40*a*, 40*b*, 40*c*, and 40*d* can be fed to a sheet feed route 43B by corresponding feed devices 41A, 41B, 41C, and 41D, and then transported to the sheet feed route 43A by a pair of transport rollers 42B. As illustrated in FIG. 5, the above-mentioned pair of registration rollers 45 is provided in the sheet feed route 43A to feed the transfer sheet P with a given timing to the above-mentioned secondary transfer nips, defined by the secondary transfer roller 46 and the transfer charger 47. Furthermore, a cross-direction position corrector 44 is provided in the sheet feed route 43A to correct an orientation of transfer sheet with respect to a transport direction of the sheet feed route 43A. Specifically, the cross-direction position corrector 44 corrects a sheet direction so that a cross-direction of the transfer sheet, which is perpendicular to the transport direction in the sheet feed route 43A, does not deviate from a given transport direction.

The cross-direction position corrector 44 includes a configuration as below. For example, the cross-direction position corrector 44 includes a reference guide in lateral side of the sheet feed route 43A and rollers (not shown), for example. The cross-direction position corrector 44 can push a lateral side of the transfer sheet with the reference guide to align the transfer sheet in a given transport direction. The reference guide can be selectively set to a given position according to a size of the transfer sheet.

The cross-direction position corrector 44 can also include a jogger type configuration. In case of jogger type, both lateral sides of the transfer sheet are pushed from both lateral directions of the transfer sheet (i.e., from right and left direction) with respect to the transport direction of the transfer sheet for a plurality of times in a short period of time to align the transfer sheet in a given transport direction.

The transfer sheet P is transported to the secondary transfer nip, defined by the roller 28 and the secondary transfer roller 46, from the pair of registration rollers 45. Then, the transfer sheet P is transported to the secondary transfer nip, defined by the second intermediate transfer belt 31 and the transfer charger 47. If the transfer sheet is too thick, then the transfer sheet cannot be fed to the sheet feed route 43A from the sheet feed trays 40*b*, 40*c*, and 40*d* because the transfer sheet cannot be bended at the transport rollers 42B provided for the sheet feed trays 40*b*, 40*c*, and 40*d* due to the thickness of the transfer sheet. In such a case, the thicker transfer sheets are stacked in the sheet feed tray 40*a* so that the thicker transfer sheet can be fed to the sheet feed route 43A. The thicker transfer sheet can be fed to the sheet feed route 43A with such a method because a height of the upper most transfer sheet in the sheet feed trays 40*a* can be set to be substantially similar to a height "h1" of the sheet feed route 43A as illustrated in FIG. 5.

Furthermore, the sheet feed tray 40*a* preferably includes a vacuum mechanism (not shown) so that various types of transfer sheets can be fed from the sheet feed tray 40*a*.

Although not shown, a sensor can be provided in the sheet feed routes 43A, 43B, and 43C to detect types of transfer sheet, and such detected information can be used to trigger signals for the image forming operation.

Furthermore, the annex sheet feed unit 300 can be provided next to the sheet feed unit 40 to feed transfer sheets to the printing unit 100 through a sheet feed route 43C having a plurality of pair of transport rollers 42C. The annex sheet feed unit 300 can include a configuration similar to the sheet feed unit 40. By providing the annex sheet feed unit 300, the image forming apparatus 1000 can conduct a higher volume of printing.

At a leftward of the second image forming section 30 in FIG. 5, a sheet transporter 50 is provided. The sheet transporter 50 receives the transfer sheet P from the second image forming section 30, and transports the transfer sheet P to a fixing nip in a fixing unit 60, where the sheet transporter 50 transports the transfer sheet P in a horizontal direction. The sheet transporter 50 includes a sheet transport belt 51, and support rollers 52, 53, 54, 55, and 56. The sheet transport belt 51 is extended by the support rollers 52, 53, 54, 55, and 56, and travels in a counterclockwise direction as shown by an arrow in FIG. 5.

As shown in FIG. 5, the sheet transport belt 51 is provided with a cleaning unit 50A, an adsorption charger 57, and a separation charger 58. The cleaning unit 50A faces the support roller 55 via the sheet transport belt 51. The adsorption charger 57 facing the support roller 56 is used to adsorb the transfer sheet P on the sheet transport belt 51 with an electrostatic effect. The separation charger 58 facing the support roller 54 is used to separate the transfer sheet P from the sheet transport belt 51 with an electrostatic effect.

The sheet transporter 50 receives the transfer sheet P, transported from the second image forming section 30, on the sheet transport belt 51. Specifically, the sheet transport belt 51 receives the transfer sheet P at a point extended by the support roller 52.

Before the sheet transport belt 51 receives the transfer sheet P, the adsorption charger 57 applies electric charge having a same polarity of toner (e.g., negative charge) on an outer face of the sheet transport belt 51. By applying such electric charge to the outer face of the sheet transport belt 51, the transfer sheet P can be electrostatically adhered on the outer face of the sheet transport belt 51 of the sheet transporter 50.

The transfer sheet P adsorbed on the outer face of the sheet transport belt 51 is transported from a right to left in FIG. 5 with a traveling of the sheet transport belt 51. Then, the sheet transport belt 51 releases the transfer sheet P to the fixing unit 60. Before releasing the transfer sheet P to the fixing unit 60, the separation charger 58 applies electric charge to the transfer sheet P, adsorbed on the outer face of the sheet transport belt 51. By applying such electric charge to the transfer sheet P, the transfer sheet P, adsorbed on the outer face of the sheet transport belt 51, can be easily separated from the outer face of the sheet transport belt 51. Then, the sheet transport belt 51 can release the transfer sheet P to the fixing unit 60 at an inflection point of the sheet transport belt 51, defined by the support roller 54, because a traveling direction of the sheet transport belt 51 changes significantly at the inflection point.

The sheet transport belt 51 can be made as a metal belt, a polyimide belt, and a polyamide belt, for example. The sheet transport belt 51 can include a surface layer having a toner separation property and having a given resistance value for charging the sheet transport belt 51.

A traveling speed of the sheet transport belt 51 can be matched to a moving speed of the transfer sheet P in the fixing unit 60. As illustrated in FIG. 5, the fixing unit 60 is provided next to the sheet transporter 50, which is a downstream side of transport direction of the transfer sheet P. The fixing unit 60 includes heat rollers 61 and 62. Although not shown, the fixing unit 60 can also include a belt type unit and an induction heating type unit, for example. In the case of the belt type unit, a heated belt travels in one direction to fix a toner image on a transfer sheet.

As shown in FIG. 5, the heat rollers 61 and 62 defines a fixing nip therebetween, and apply heat to the transfer sheet P from both of the heat rollers 61 and 62 to fix the first and second toner image on both faces (i.e., first and second face) of the transfer sheet P. In order to realize a same image quality (e.g., coloring and glossiness) on both faces (i.e., first and second face) of the transfer sheet P, the heat roller 61 and 62 are made of substantially similar material and have a substantially similar hardness and surface properties. Furthermore, the controller 95 can change fixing conditions of the fixing unit 60 depending on image forming mode such as full-color mode/monochrome mode, one-face image forming mode/both-face image forming mode, or depending on types of transfer sheets to be used for printing.

After fixing the toner image on the transfer sheet P, the transfer sheet P is fed to a cooling unit 70 provided next to the fixing unit 60 as illustrated in FIG. 5. The cooling unit 70 cools the transfer sheet P to completely fix a toner image on the transfer sheet P in a shorter period of time. The cooling unit 70 can employ heat-pipe rollers to facilitate a heat-radiating effect, for example.

The cooled transfer sheet P is ejected by a pair of sheet ejection rollers 71 and stacked on a sheet stack 75, provided in a left side of the printing unit 100 as illustrated in FIG. 5. The sheet stack 75 can include a movable sheet-receiving tray (not shown), which can be moved in a vertical direction so that a larger amount of transfer sheets can be stacked in the sheet stack 75. Furthermore, the transfer sheet P passed through the sheet stack 75 can be transported to another processing unit such as hole-punching unit, sheet-cutting unit, sheet-bending unit, and sheet-binding unit, for example.

The toner bottles 86Y, 86M, 86C, and 86K are detachable from the bottle compartment 85. The bottle compartment 85 is provided on the top face of the printing unit 100 and backward of the printing unit 100 (i.e., the bottle compartment 85 is far from a front side where a user operates the image forming apparatus 1000). Therefore, a flat face can be secured on the top face of the printing unit 100, and a user can use the flat face for placing something such as sheets thereon.

With the above-mentioned toner supply unit (not shown), toners can be supplied to the developing unit 500, as required. In an exemplary embodiment, the same color toner can be supplied to the corresponding developing unit 500 in the first image forming section 20 and the second image forming section 30 from a common toner bottle containing one color toner. However, one color toner can be supplied to the corresponding developing unit 500 in the first image forming section 20 and the second image forming section 30 from different toner bottles storing the one color toner.

In case of the toner bottle 86K, the toner bottle 86K can be formed into a larger capacity type compared to other toner bottles 86Y, 86M, and 86C because the black toner is consumed in a shorter period of time compared to other color toners, in general.

Depending on a usage of the image forming apparatus 1000, a size of toner bottles 86Y, 86M, 86C, and 86K can be varied, as required.

As illustrated in FIG. 5, the operation/display unit 90 is provided on the top face of the printing unit 100. The operation/display unit 90 includes a keyboard to input operating information such as image forming conditions. The operation/display unit 90 also includes a display such as liquid crystal display (LCD) to display information thereon. An operator can use the display to facilitate information communication with the printing unit 100.

As illustrated in FIG. 5, the printing unit 100 also includes a waste toner compartment 87, which is detachably provided in a lower portion of the printing unit 100. The waste toner compartment 87 is connected to the cleaning units 2, 20A, 30A, and 50A, and is separate from the cleaning units 2, 20A, 30A, and 50A. The waste toner compartment 87 recovers foreign objects such as paper powder and waste toner from the cleaning units 2, 20A, 30A, and 50A, and stores the foreign objects therein. Accordingly, the cleaning units 2, 20A, 30A, and 50A can be miniaturized by providing the waste toner compartment 87 having a larger capacity to store foreign objects.

Furthermore, the waste toner compartment 87 can be easily detached from the image forming apparatus 1000 when discarding recovered foreign objects such as paper powder and waste toner.

The waste toner compartment 87 can be provided with a sensor (not shown) to detect an amount of recovered foreign objects such as paper powder and waste toner in the waste toner compartment 87, and an alarm signal can be generated based on the sensor information when a replacement of the waste toner compartment 87 is required for discarding foreign objects such as paper powder and waste toner.

As illustrated in FIG. 5, the printing unit 100 includes the controller 95. The controller 95 includes power sources and control circuits placed on a circuit frame.

As illustrated in FIG. 5, the printing unit 100 also includes a fan 96. Due to a heat generation at the fixing unit 60 and other units, temperature increases in the image forming apparatus 1000, which is not a favorable phenomenon. The fan 96 is provided in the printing unit 100 to mitigate an effect of such heat effect, which may cause functional degradation of parts in the image forming apparatus 1000. The fan 96 can be connected to the heat-pipe rollers of the cooling unit 70 to improve a cooling effect of the cooling unit 70.

As illustrated in FIG. 5, the automatic document feeder (ADF) 200 is provided on the sheet feed unit 40. The ADF 200 can automatically feed document sheets to read images of document. The information read by the ADF 200 is transmitted to the controller 95. Based on such information, the controller 95 controls the printing unit 100 to produce an image pattern read by the ADF 200.

Furthermore, a personal computer (not shown) can transmit image information to the printing unit 100, and the printing unit 100 can produce an image corresponding to such image information.

Furthermore, image information can be transmitted to the printing unit 100 from a telephone line (not shown), and the printing unit 100 can produce an image corresponding to such image information.

Hereinafter, an image forming process for forming a full-color toner image on one face of the transfer sheet P with the printing unit 100 is explained. Such a process can be referred as one-face recording method.

The one-face recording method includes two types, which can be selected by an operator. A first type method is a process used to transfer a four-color toner image to the first face of the transfer sheet P from the first intermediate transfer belt 21. A second type method is a process used to transfer a four-color toner image to the second face of the transfer sheet P from the second intermediate transfer belt 31.

If images are produced on a plurality of transfer sheets, it is preferable to control an image forming sequence so that the plurality of transfer sheets can be stacked on the sheet stack 75 sequentially. The above-mentioned first type method can record images on transfer sheets in an order of from the last page to front page of documents. The above-mentioned second type method can record images on transfer sheets in an order of from the front page to last page of documents.

Hereinafter, an image forming process using the first image forming section 20 for the above-mentioned first type method is explained.

When the printing unit 100 is operated for image forming, the first intermediate transfer belt 21 and the photosensitive members 1Y, 1M, 1C, and 1K in the first process units 80Y, 80M, 80C, and 80K rotate. At the same time, the photosensitive members 1Y, 1M, 1C, and 1K in the second process units 81Y, 81M, 81C, and 81K are disengaged from the second intermediate transfer belt 31, and are controlled to a non-rotating condition although the second intermediate transfer belt 31 travels in a counter-clockwise direction as shown by an arrow in FIG. 5.

Then, the first process unit 80Y starts an image forming process. The optical writing unit 4, including an LED (light emitting diode) array and a focusing device, emits a light beam from the LED array, corresponding to the yellow image data, to form an electrostatic latent image for yellow image on the surface of the photosensitive member 1Y, which is uniformly charged by the scorotron charger 3. The electrostatic latent image is developed as a yellow toner image by the developing unit 500 in the first process unit 80Y, and the yellow toner image is then electro-statistically transferred to the first intermediate transfer belt 21 at a primary transfer nip for a yellow image.

Similarly, such developing and primary transfer processes are sequentially conducted on the photosensitive members 1M, 1C, and 1K with a given timing. Then, magenta, cyan, and black toner image are sequentially and super-imposingly transferred on the yellow toner image formed on the first intermediate transfer belt 21 at a respective primary transfer nip for a magenta, a cyan, and a black image. Thus, a four-color toner image is formed on the first intermediate transfer belt 21. Then, the four-color toner image on the first intermediate transfer belt 21 can be moved in a direction shown by an arrow in FIG. 5 with a traveling of the first intermediate transfer belt 21.

As for the sheet feed unit 40, the transfer sheet P matched to a to-be-produced image can be supplied from any one of the sheet feed trays 40*a*, 40*b*, 40*c*, and 40*d* by using the feed devices 41A, 41B, 41C, and 41D. Then, the pair of transport rollers 42B transport the transfer sheet P to the sheet feed route 43A in the printing unit 100. Then, the transfer sheet P is transported to the cross-direction position corrector 44.

The cross-direction position corrector 44 corrects an orientation of the transfer sheet P if the transfer sheet P is tilted from a given transport direction when the transfer sheet P is transported from the sheet feed unit 40 to the first image forming section 20. In an upstream of the transport direction with respect to the pair of registration rollers 45, the cross-direction position corrector 44 includes a guide plate (not shown), provided on each lateral side of the sheet feed route 43A. Each guide plate (not shown) can be abutted to a lateral side of the transfer sheet P from each lateral side of the transfer sheet P to correct the orientation of the transfer sheet P if the transfer sheet P is tilted from the predetermined transport direction.

A distance between the two guide plates can be adjusted in a direction perpendicular to the transport direction, by which the distance between the two guide plates can be adjusted depending on types of transfer sheet fed from the sheet feed unit 40. Therefore, such guide plates can be used for a variety of different types of transfer sheets fed from the sheet feed unit 40.

After correcting orientation of the transfer sheet P with the cross-direction position corrector 44, the transfer sheet P is fed to the pair of registration rollers 45. The registration rollers 45 feed the transfer sheet P to the secondary transfer nip, defined by the roller 28 and the secondary transfer roller 46, with a predetermined timing. A bias voltage applied to the secondary transfer roller 46 has a polarity, which is opposite to the polarity of toners. At such secondary transfer nip, the four-color toner image formed on the first intermediate transfer belt 21 is transferred to the first face of the transfer sheet P.

After transferring the four-color toner image to the first face of the transfer sheet P at such secondary transfer nip, the outer face of the first intermediate transfer belt 21 is cleaned by the cleaning unit 20A to remove toners remaining on the first intermediate transfer belt 21.

At each of the first process units 80Y, 80M, 80C, and 80K, the cleaning unit 2 cleans the respective photosensitive members 1Y, 1M, 1C, and 1K to remove toners remaining on the photosensitive members 1Y, 1M, 1C, and 1K after transferring toner images to the first intermediate transfer belt 21 from the photosensitive members 1Y, 1M, 1C, and 1K. As illustrated in FIG. 6, the cleaning unit 2 includes the cleaning brush 2*a* and cleaning blade 2*b* to remove toners remaining on the photosensitive member 1Y, 1M, 1C, and 1K. Removed foreign objects such as toner are collected by the collector 2*c*, and then sent to the waste toner compartment 87.

The electric potential sensor S1 detects electric potential of the surface of the photosensitive member 1 scanned by a light beam. The image sensor S2 detects toner concentration adhered on the surface of the photosensitive member 1 after developing the electrostatic latent image as a toner image. The electric potential sensor S1 and the image sensor S2 transmit information to the controller 95, and the controller 95 adjusts image forming conditions based on such information.

After cleaning the surface of the photosensitive member 1 with the cleaning unit 2, the de-charging unit Q de-charges the photosensitive member 1 to prepare for a next image forming process.

As illustrated in FIG. 5, the transfer sheet P having the four-color toner image on its first face is transported onto the second intermediate transfer belt 31, and then transported to the sheet transporter 50. Before transporting the transfer sheet to the fixing unit 60 from the sheet transporter 50, a separation charger 58 applies electric charges to the transfer sheet P. With such electric charges, the transfer sheet P adhered electro-statistically to the second intermediate transfer belt 31 can be easily separated from the second intermediate transfer belt 31.

In the fixing unit 60, toners in the full-color toner image on the first face of the transfer sheet P can be melted by heat. Because the full-color toner image is formed only on the first face of the transfer sheet P, heat energy for fixing the full-color toner image on the transfer sheet P is smaller than heat energy for fixing full-color toner image on both faces (i.e., first and second faces) of the transfer sheet P. The controller 95 controls electric power to be supplied to the fixing unit 60 at a preferable level depending on image forming condition.

However, toners on the transfer sheet P are not completely fixed on the transfer sheet in the fixing unit 60. If toners are not completely fixed on the transfer sheet P, an image quality of the full-color toner image may be degraded if the transfer sheet P is scratched by a component provided along a transport route in the image forming apparatus 1000, by which unfavorable phenomenon such as image drop and image disturbance may occur. In order to prevent such drawback, the transfer sheet P, passed through the fixing unit 60, is then fed to the cooling unit 70.

After the full-color toner image is completely fixed on the transfer sheet P in the cooling unit 70, the transfer sheet P is ejected to the sheet stack 75 by the pair of sheet ejection rollers 71. At the sheet stack 75, ejected transfer sheets are sequentially stacked one by one in an order of "from last page to front page" of the document read by the ADF 200, thereby a page order of the ejected transfer sheets can be collated at the sheet stack 75. The sheet stack 75 can be configured to be moved to a downward direction with an increase of numbers of ejected transfer sheets, by which transfer sheets can be stacked with an order of "from last page to front page" of the document read by the ADF 200.

Furthermore, instead of stacking the transfer sheets directly on the sheet stack 75, transfer sheets can be transported to another processing unit such as hole-punching unit, sorting unit, collating unit, sheet-cutting unit, sheet-bending unit, and sheet-binding unit, for example.

In the above explanation, a method of transferring a four-color toner image to the first face of the transfer sheet from the first intermediate transfer belt 21 is explained.

Similarly, the above-mentioned second type method for transferring a four-color toner image to the second face of the transfer sheet from the second intermediate transfer belt 31 can be used to record an image on one face of the transfer sheet. In this case, instead of using the first process units 80Y, 80M, 80C, and 80K, an image forming is conducted by using the second process units 81Y, 81M, 81C, and 81K.

The above-mentioned first and second type methods can record images on transfer sheets in a substantially similar manner to each other except that the second type method can record images in an order of "from the front page to last page" of document read by the ADF 200. Therefore, an explanation for forming an image on one face of a transfer sheet with the second process units 81Y, 81M, 81C, and 81K is omitted.

Hereinafter, a both-face image forming method for forming images on both faces (i.e., first and second faces) of a transfer sheet P is explained.

When image signals are input to the printing unit 100, yellow, magenta, cyan, and black toner images are formed on the respective photosensitive members 1Y, 1M, 1C, and 1K in the first process units 80Y, 80M, 80C, and 80K as explained in the above described one-face image forming method. Then, yellow, magenta, cyan, and black toner images are sequentially and super-imposingly transferred to the first intermediate transfer belt 21 at each primary transfer nip for Y, M, C, and K images.

When Y, M, C, and K toner images are formed in the first process units 80Y, 80M, 80C, and 80K, Y, M, C, and K toner images are also formed on the photosensitive members 1Y, 1M, 1C, and 1K in the second process units 81Y, 81M, 81C, and 81K in a substantially concurrent manner. Similar to the first intermediate transfer belt 21, the Y, M, C, and K toner images are sequentially and super-imposingly transferred to the second intermediate transfer belt 31 at each primary transfer nip for Y, M, C, and K toner images.

With such processes, the four-color toner image is formed on each of the first intermediate transfer belt 21 and the second intermediate transfer belt 31.

The transfer sheet P is stopped at the pair of registration rollers 45 and then fed from the pair of registration rollers 45. Then, the pair of registration rollers 45 feed a transfer sheet P to the secondary transfer nip, defined by the second transfer roller 46, with a predetermined timing to transfer the four-color toner image to the first face of the transfer sheet P from the first intermediate transfer belt 21, and then the transfer sheet P is transported onto the second intermediate transfer belt 31. At the secondary transfer nip, defined by the transfer charger 47, the four-color toner image is transferred to the second face of the transfer sheet P from the second intermediate transfer belt 31.

With such process, the full-color toner image is formed on both faces (i.e., first and second faces) of the transfer sheet P.

The transfer sheet P having the full-color image on its both faces is transported to the fixing unit 60 by the sheet transport belt 51 of the sheet transporter 50. The adsorption charger 57 charges the outer face of the sheet transport belt 51 with electric charge having a same polarity as that of the toner (e.g., negative charge), by which an unfixed image on the second face of the transfer sheet P may not be transferred to the sheet transport belt 51. Then, the transfer sheet P is separated from the sheet transport belt 51 with an effect of the separation charger 58, and transported to the fixing unit 60.

In the fixing unit 60, a fixing process using heat and pressure is conducted on the transfer sheet P to melt the toner images on the both faces (i.e., first and second faces) of the transfer sheet P. Then, the transfer sheet P is fed to the cooling unit 70, and then ejected to the sheet stack 75 by the pair of sheet ejection rollers 71.

In case of forming images on both faces (i.e., first and second faces) of a plurality of transfer sheets, a stacking sequence of the transfer sheets on the sheet stack 75 is controlled so that a first transfer sheet, having an image of page 1 and an image of page 2 of the document on both faces of the first transfer sheet, can be stacked on a surface of the sheet stack 75 by facing the image of page 1 to the surface of the sheet stack 75. Similarly, a second transfer sheet, having an image of page 3 and an image of page 4 of the document on both faces of the second transfer sheet, is stacked on the page 2 of the first transfer sheet by facing the image of page 3 of the second transfer sheet to the image of page 2 of the first transfer sheet. Such stacking is continued for each transfer sheet having images on its both faces. After finishing such stacking, a bundle of the transfer sheets can be picked up from the sheet stack 75. Accordingly, a page order of the transfer sheets can be set from "page 1, page 2, page 3, and so on."

The controller 95 can control such image forming sequence of the transfer sheets and adjust electric power to be supplied to the fixing unit 60. For example, the controller 95 controls electric power to a higher level when conducting a both-face image forming mode compared to one-face image forming mode.

In the above, a method of forming full-color image on one face or both faces (i.e., first and second faces) of a transfer sheet is explained, but such method can be also used for forming monochrome image on one face or both faces (i.e., first and second faces) of a transfer sheet.

As for the image forming apparatus 1000, if a maintenance work or replacement work is required for the image forming apparatus 1000, an outer cover (not shown) can be opened to conduct the maintenance work or replacement work. Once the outer cover (not shown) is opened, replacement units or parts can be removed from the image forming apparatus 1000.

Hereinafter, the developing unit 500 according to an exemplary embodiment is explained in detail with reference to FIGS. 8 and 9A.

Figure 8:
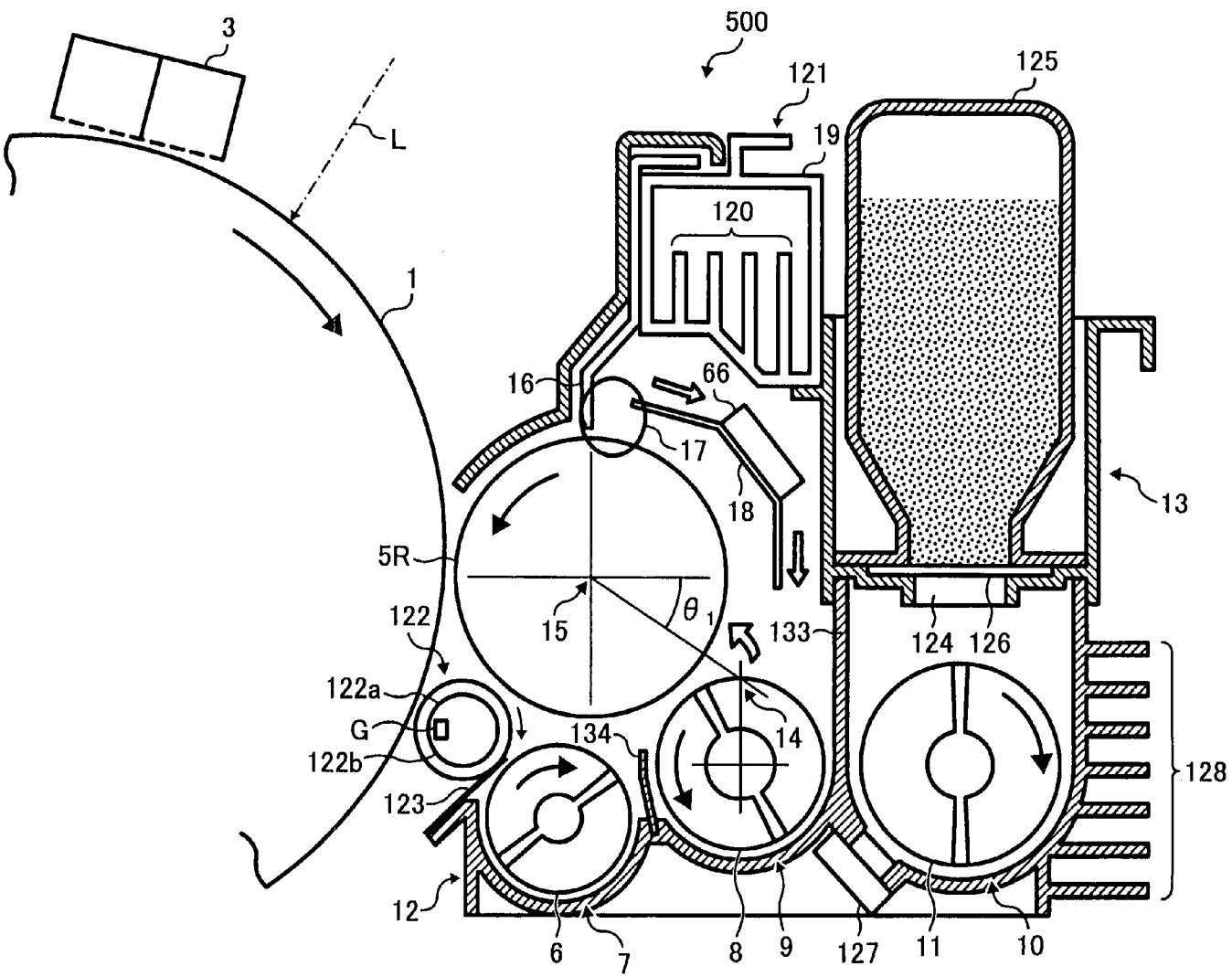
FIG. 8 is a schematic configuration of a developing unit according to an exemplary embodiment.
Figure 9A:
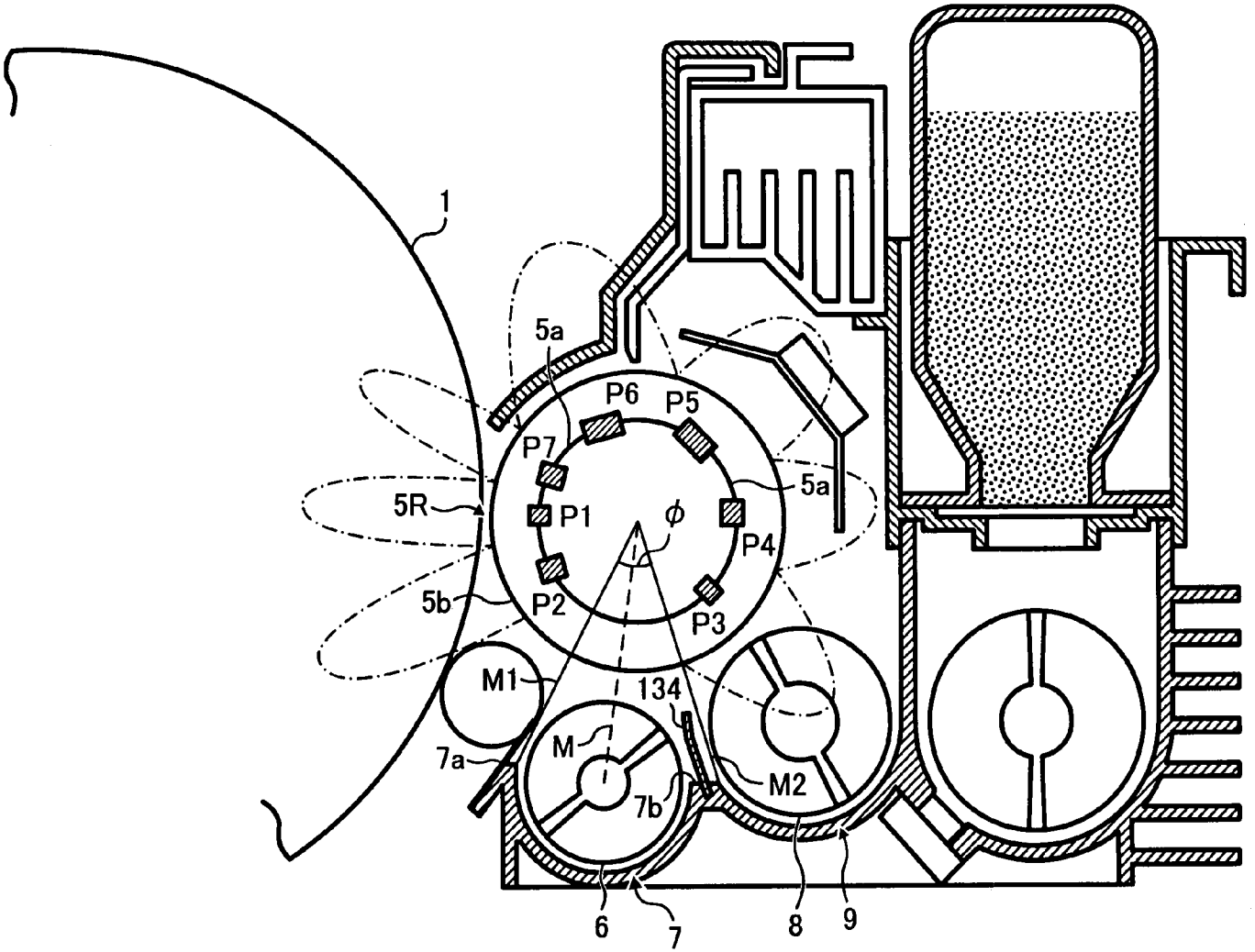
FIG. 9A is a view explaining a magnetic flux density in a normal line direction of a developing roller.

FIG. 8 is a schematic configuration of the developing unit 500 according to an exemplary embodiment, and FIG. 9A is a view explaining a magnetic flux density in a normal line direction of a developing roller of the developing unit 500.

The developing unit 500 includes a developing roller 5R, and a doctor blade 16. The developing roller 5R faces the photosensitive member 1 through an opening of a casing of the developing unit 500. The doctor blade 16 regulates an amount of developing agent to be carried on the developing roller 5R.

As shown in FIG. 9A, the developing roller 5R includes a magnet roller 5*a*, and a developing sleeve 5*b*. The magnet roller 5*a* includes a plurality of magnets P1, P2, P3, P4, P5, P6, and P7 to generate a magnetic field, and the developing sleeve 5*b* coaxially rotate around the magnet roller 5*a*. The magnet roller 5*a* forms a magnetic flux density distribution shown in FIG. 9A. The magnetic flux density distribution will be explained in detail later.

In the under part of the developing roller 5R, a developing agent container is provided to contain a two-component developer comprised of toner and carrier. The developing agent container includes a recovery compartment 7, a supply compartment 9, and an agitation compartment 10, separated from each other as shown in FIG. 8. The recovery compartment 7 is used to recover a used developing agent after a developing operation is conducted, where the used developing agent means a developing agent that is carried up on the developing roller 5R and used for developing operation. The supply compartment 9 is used to supply the developing agent to the developing roller 5R.

The recovery compartment 7 includes a recovery screw 6, the supply compartment 9 includes a supply screw 8, and the agitation compartment 10 includes an agitation screw 11 as shown in FIG. 8. The agitation compartment 10 is used to agitate the developing agent therein.

As shown in FIG. 8, the recovery compartment 7 and the supply compartment 9 are separated by a separation wall 134, and the supply compartment 9 and the agitation compartment 10 are separated by a separation wall 133.

As shown in FIG. 8, three compartments of the recovery compartment 7, supply compartment 9, and agitation compartment 10, or three screws of recovery screw 6, supply screw 8, and agitation screw 11 are provided side-by-side in a horizontal direction and under the developing roller 5R in the developing unit 500. Furthermore, the recovery compartment 7, supply compartment 9, and agitation compartment 10 are connected to each other so that the developing agent can be circulated among the recovery compartment 7, supply compartment 9, and agitation compartment 10.

The casing of the developing unit 500 includes a lower casing 12 and upper casing 13 as shown in FIG. 8. The lower casing 12 includes the separation wall 133 and separation wall 134. The separation wall 133 is a part of the lower casing 12, and the separation wall 133 engages with the upper casing 13 as shown in FIG. 8.

As shown in FIG. 8, the supply screw 8 has a top peripheral point 14, and the developing roller 5R has a center 15. The supply screw 8 is preferably provided at a position that a first straight line, extending from the center 15 to the top peripheral point 14, and a second straight line, extending from the center 15 in a horizontal direction, form an angle $\theta_1$ in a range of 10° to 40° as shown in FIG. 8. With such configuration, the top peripheral point 14 of the supply screw 8 may come below the center 15 of the developing roller 5R.

With such a configuration in which the top peripheral point 14 of the supply screw 8 comes below the center 15 of the developing roller 5R, an amount of the developing agent to be supplied to the developing roller 5R can be substantially determined by a magnetic force strength of the developing roller 5R. The weight of the developing agent may not substantially influence the amount of the developing agent to be supplied to the developing roller 5R because the developing agent in the supply compartment 9 may not drop to the developing roller 5R in the above-described configuration for the supply screw 8 and the developing roller 5R. With such a configuration, the amount of the developing agent to be supplied to the developing roller 5R can be controlled by a magnetic force strength of the developing roller 5R, by which a given amount of the developing agent can be effectively supplied to the developing roller 5R from the developing agent transported at an upper portion in the supply compartment 9. Accordingly, a preferable amount of the developing agent can be supplied to the developing roller 5R from the supply compartment 9 even if the developing agent in the supply compartment 9 has some uneven height in a transport direction in the supply compartment 9, or even if the developing agent distribution in an axial direction of the supply screw 8 is somewhat uneven.

If the angle $\theta_1$ becomes too small (e.g., less than 10°), the developing agent stirred up by the supply screw 8 may adhere to the developing roller 5R because such stirred-up developing agent may be dropped to the developing roller 5R due to a gravity effect acting on its own weight. Such condition is not a preferable phenomenon.

If the angle $\theta_1$ becomes too large (e.g., greater than 40°), the recovery compartment 7 may not be provided under the developing roller 5R unless the developing roller 5R has a larger diameter. However, the developing roller 5R having a larger diameter is not preferable from the viewpoint of miniaturization of the developing unit 500.

By setting the angle $\theta_1$ from 10° to 40°, the amount of the developing agent to be supplied to the developing roller 5R may not be affected by the weight of the developing agent, and the amount of the developing agent to be supplied to the developing roller 5R can be substantially determined by the magnetic force strength of the developing roller 5R. Furthermore, the recovery compartment 7 can be provided below the developing roller 5R by setting the angle $\theta_1$ from 10° to 40°, by which a miniaturization of the developing unit 500 can be obtained.

The doctor blade 16 can regulate a thickness of developing agent supplied onto a surface of the developing roller 5R, by which the thickness of layer of the developing agent on the surface of the developing roller 5R can be regulated to a preferable level for developing operation. An amount of developing agent to be supplied to the developing roller 5R is set to a larger value compared to an amount of developing agent, which passes through the doctor blade 16, because the doctor blade 16 regulates an amount of the developing agent to obtain a preferable level of thickness of layer of the developing agent on the developing roller 5R. Accordingly, the developing agent supplied to the developing roller 5R is regulated by the doctor blade 16.

The developing agent regulated by the doctor blade 16 may accumulate on a doctor area 17, which is a downstream side of the doctor blade 16, when the developing operation is conducted repeatedly. Such regulated developing agent is pushed up by a new developing agent, supplied to the developing roller 5R in later and transported to the doctor area 17. The pushed-up developing agent is then dropped to the doctor area 17 on the developing roller 5R. Accordingly, the developing agent may conduct a convection movement at the doctor area 17.

The developing unit 500 includes a regulated agent recovery unit 18 above the developing roller 5R as shown in FIG. 8. When a given amount of developing agent regulated by the doctor blade 16 accumulates on the doctor area 17, the regulated agent recovery unit 18 can flow back the accumulated developing agent to the supply compartment 9 to avoid an accumulation and convection of the developing agent on the doctor area 17. The regulated agent recovery unit 18 may be positioned at an area where the magnetic force of the developing roller 5R does not effect to the developing agent because the developing agent can be accumulated on the regulated agent recovery unit 18 if the magnetic force of the developing roller 5R effects to the regulated agent recovery unit 18.

As shown in FIG. 8, the doctor blade 16 can be connected to a heat radiation member 19 fixed to the upper casing 13. With such a configuration, heat of the developing agent can be transmitted to the heat radiation member 19 via the doctor blade 16. The heat radiation member 19 includes a fin 120 as shown in FIG. 8. The fin 120 conducts heat release with airflow in the heat radiation member 19. With such configuration, a temperature of the developing agent may not increase significantly. Furthermore, the heat radiation member 19 can include a guide member 121, which is used as a guide when attaching or detaching the developing unit 500 into the printing unit 100.

Furthermore, the lower casing 12 can include a heat release fin 128. With the heat release fin 128 and a cooling airflow in the printing unit 100, the developing unit 500 can be cooled, and thereby a temperature increase of the developing unit 500 can be suppressed.

As shown in FIG. 8, the photosensitive member 1 and the developing roller 5R face each other at a developing area. Under the developing area, an agent catching roller 122 is provided as shown in FIG. 8. The agent catching roller 122 includes a sleeve 122*a*, a magnet roller 122*b*, where the magnet roller 122*b* includes a magnet G therein. The magnet G faces the photosensitive member 1 via the sleeve 122*a* and magnet roller 122*b* as shown in FIG. 8.

With a magnetic force of the magnet G, the agent catching roller 122 can catch magnetic carriers adhered on the photosensitive member 1 and the developing agent dropped from the developing roller 5R. The agent catching roller 122 can be rotated in a direction shown by an arrow in FIG. 8, which is an opposite rotation of the developing roller 5R, to return the magnetic carriers and developing agent to the developing roller 5R. Such developing agent can be recovered to the recovery compartment 7 with an effect of a scraper 123.

The upper casing 13, provided over the agitation compartment 10, includes an opening 124 as shown in FIG. 8, and an agent cartridge 125 can be held at the opening 124. The agent cartridge 125 can be set before shipping a product or when to replace the agent cartridge 125. Once the agent cartridge 125 is set in the opening 124, a cartridge seal 126 is removed from the agent cartridge 125, by which the developing agent can be supplied into the developing unit 500 from the agent cartridge 125 through the opening 124. With such a configuration using a cartridge type container, a refilling of developing agent can be easily conducted.

As shown in FIG. 8, the lower casing 12 can include a toner concentration sensor 127 under the agitation screw 11. Based on a signal from the toner concentration sensor 127, a toner supply unit (not shown) supplies toner to the agitation compartment 10, as required. The toner supply unit can employ a mohno pump to supply toner.

Such a configuration is preferable because of less restriction on installation design of the cartridge, and a resultant higher freedom for space allocation in an image forming apparatus. Furthermore, such a configuration is preferable because toner can be supplied at a given timing without providing a larger toner storage in the developing unit 500. Accordingly, the developing unit 500 can be miniaturized.

Hereinafter, an arrangement of screws in the developing unit 500 is explained in detail.

Figure 10:
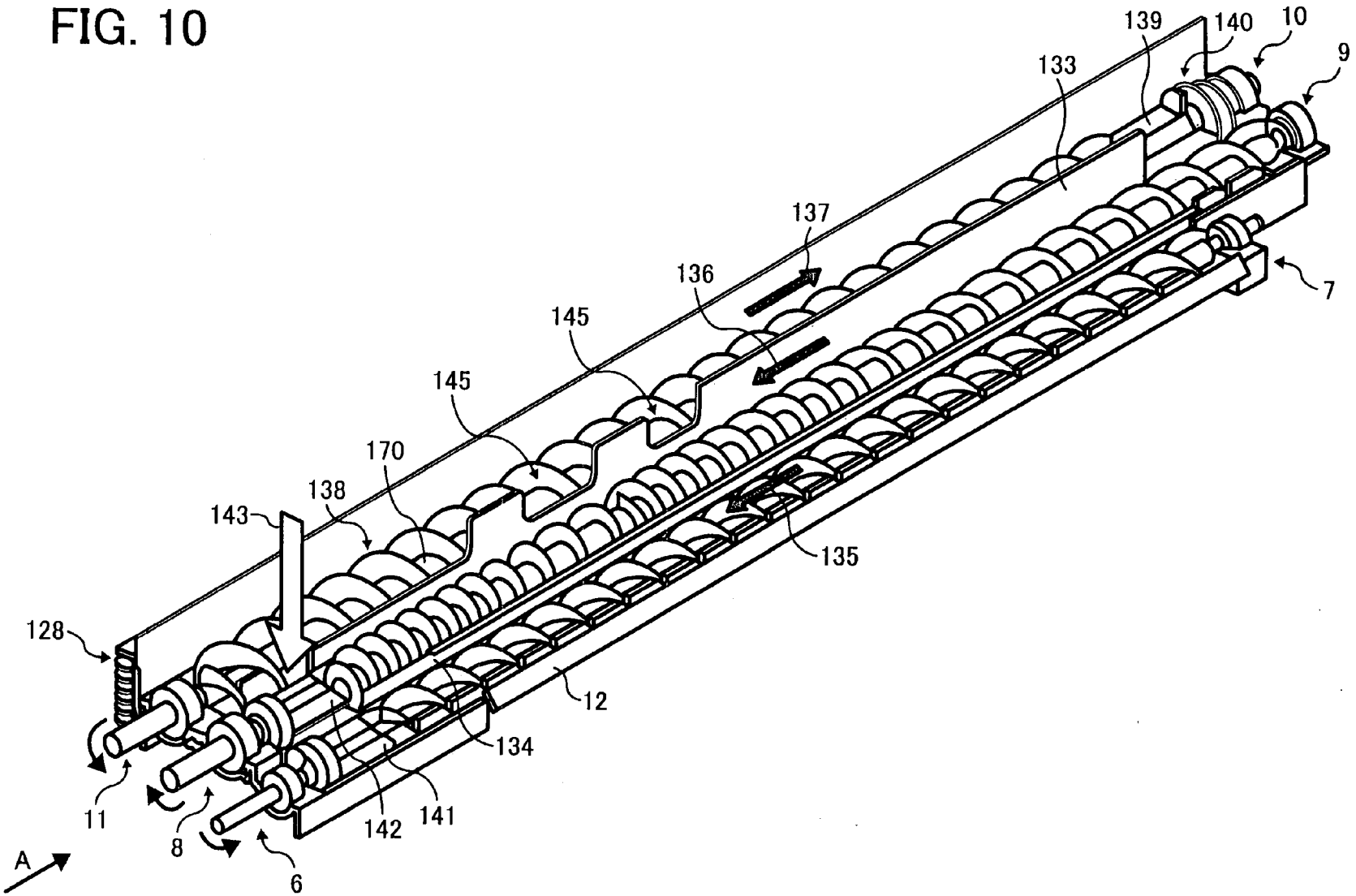
FIG. 10 is a perspective view of an under part of a developing unit including a plurality of screws.
Figure 11:
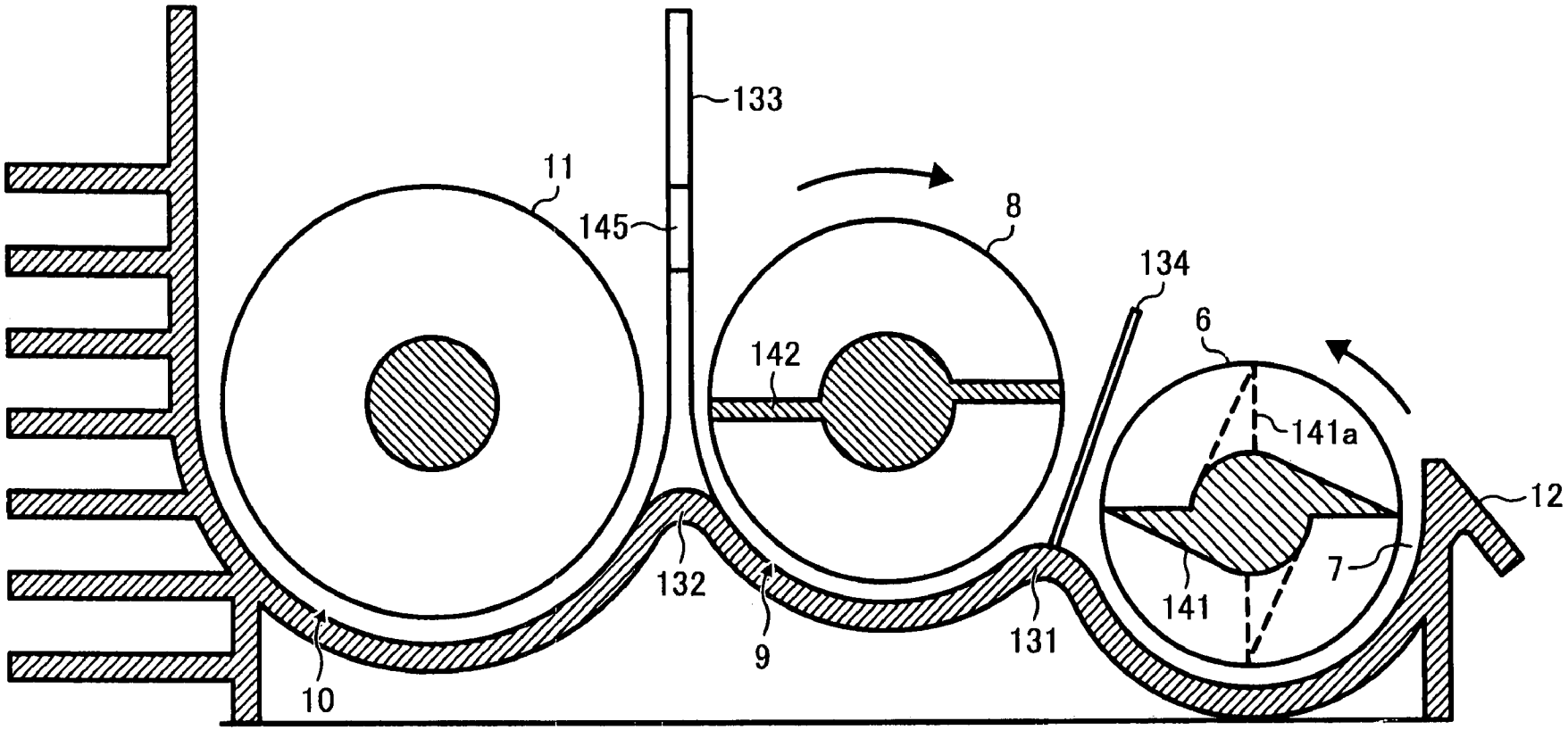
FIG. 11 is a schematic cross sectional explaining a configuration of a plurality of screws for transporting developing agent.

FIG. 10 is a perspective view of an under part of the developing unit 500, in which the upper casing 13 is removed from the developing unit 500, and a perspective view of each screw provided in the lower casing 12 is viewed from the photosensitive member 1 side. FIG. 11 is a cross sectional view when the lower casing 12 is viewed from a direction A shown in FIG. 10.

As shown in FIGS. 10 and 11, the recovery screw 6 includes a first paddle 141, and the supply screw 8 includes a second paddle 142.

As shown in FIG. 10, the developing agent container includes the recovery screw 6, supply screw 8, and agitation screw 11 side-by-side, and each transporting area of each screw is separated from each other. The separation wall 134, included in the lower casing 12, separates the supply compartment 9 and recovery compartment 7. The separation wall 133 separates the supply compartment 9 and agitation compartment 10, where the separation wall 133 extends from the lower casing 12 and engages with the upper casing 13 as shown in FIG. 10.

The developing agent transported in the recovery compartment 7 by the recovery screw 6 travels in a direction shown by an arrow 135 shown in FIG. 10. The developing agent transported in the supply compartment 9 by the supply screw 8 travels in a direction shown by an arrow 136 shown in FIG. 10. The developing agent transported in the agitation compartment 10 by the agitation screw 11 travels in a direction shown by an arrow 137 shown in FIG. 10. The direction shown by the arrows 135 and 136 is a same direction, and the direction shown by the arrow 137 is a direction which is opposite to the direction shown by the arrows 135 and 136.

The used developing agent in the recovery compartment 7, developing agent in the supply compartment 9, and agitated developing agent in the agitation compartment 10 are moved in a transversal direction with the above-mentioned first paddle 141 of the recovery screw 6 and the second paddle 142 of the first supply screw 8.

If each compartment has a flat face bottom and such compartments are connected to each other side-by-side, the above-mentioned paddles provided for each screw may not effectively stir and transport the developing agent because the paddle may not reach some space near the flat face bottom of the each compartment. For example, the paddle may not reach a corner of the each compartment. Accordingly, the lower casing 12 includes a first convexed portion 131 and a second convexed portion 132 in the lower casing 12 as shown in FIG. 11.

The first convexed portion 131 is corresponded to the separation wall 134, which separates the recovery compartment 7 and supply compartment 9. The second convexed portion 132 is corresponded to the separation wall 133, which separates the supply compartment 9 and agitation compartment 10. With the configuration shown in FIG. 11, the developing agent, which overpasses each convexed portion, cannot backflow to an original compartment.

Although the first paddle 141 has two blades, the first paddle 141 can increase a number of blades by considering a transportation amount of the developing agent. For example, the first paddle 141 can include four blades by adding two blades, which is shown by a dotted line 141*a*.

The second paddle 142 in the supply compartment 9 is used to receive the developing agent from the supply compartment 7, and to push out the developing agent to the agitation compartment 10. Therefore, the second paddle 142 has a flat blade shape, which has little angle compared to the first paddle 141.

As shown in FIG. 10, toners can be supplied from a pass-through portion 143 provided between the supply screw 8 and agitation screw 11. The toner can be effectively agitated at the pass-through portion 143 because the second paddle 142 stirs the developing agent, to be moved in a transversal direction, at the pass-through portion 143.

If the toner can be refilled from the pass-through portion 143, where an effective agitation can be conducted, refilled toner can be agitated and mixed with the developing agent with a shorter period of time. Toner can be refilled from any another pass-through portion provided between the recovery screw 6 and supply screw 8 instead of the pass-through portion 143 provided between the supply screw 8 and agitation screw 11.

Hereinafter, a configuration of each screw is explained by using the agitation screw 11 as an example.

As shown in FIG. 10, the agitation screw 11 includes a shaft 170, an agitation blade 138, and a third paddle 139. The agitation blade 138 is wound around the shaft 170 with a given winding angle to agitate and transport the developing agent along the shaft 170. The third paddle 139 can be used to move the developing agent from the agitation screw 11 to the supply screw 8, which is adjacent to the agitation screw 11.

Furthermore, the agitation screw 11 includes a reverse-agitation blade 140 at a downstream end of the agitation screw 11. The reverse-agitation blade 140 is wound around the agitation screw 11 with a reverse angle with respect to the agitation blade 138. With such a reverse angled blade (i.e., reverse-agitation blade 140) that transports the developing agent in a reverse direction with respect to the transport direction by the agitation blade 138, the developing agent cannot intrude into a bearing portion, which is provided at the downstream end of the agitation screw 11.

The recovery screw 6 and supply screw 8 can have a substantially similar configuration as the agitation screw 11 as a whole.

The developing unit 500 includes the following screws, as examples: an agitation screw having an outer diameter of 26 mm, a pitch of 36 mm, and number of screw thread of 2; a supply screw having an outer diameter of 22 mm, a pitch of 36 to 10 mm, and a number of screw thread of 1 to 2; a recovery screw having an outer diameter of 19 mm, a pitch of 34 mm, and a number of screw thread of 2.

The above-mentioned supply screw includes one screw thread and a fixed pitch. However, the supply screw can include a plurality of screw threads, or a screw thread having pitches that are narrowed in a step-wise manner from an upstream to a downstream along the shaft of screw.

As shown in FIG. 10, an opening is provided at one end of the separation wall 133, where the third paddle 139 of the agitation screw 11 faces such an opening. Therefore, the developing agent agitated in the agitation compartment 10 can be moved to the supply compartment 9 through the opening with the third paddle 139. Another end of the separation wall 133 is also provided with an opening, which faces the second paddle 142 of the supply screw 8 as shown in FIG. 10. Furthermore, one end of the separation wall 134 is also proved with an opening, which faces the second paddle 142 of the supply screw 8.

With such a configuration, the recovered developing agent in the recovery compartment 7 can be moved to the second paddle 142 through the opening provided at the end of the separation wall 134 by a rotation of the first paddle 141. The second paddle 142 can move the developing agent, transported from the recovery compartment 7, and the developing agent, which is not supplied to the developing roller 5R during the transportation in the supply compartment 9, to the agitation compartment 10.

Furthermore, the separation wall 133 includes a height adjustment opening 145 as shown in FIG. 10. In FIG. 10, the separation wall 133 includes a plurality of height adjustment openings 145 in a downstream side of transport direction in the supply compartment 9. A bottom height of the height adjustment opening 145 is set to a higher level compared to a given height of the developing agent in the supply compartment 9.

If an amount of developing agent to be supplied to the developing roller 5R becomes smaller, or if an amount of developing agent to be flowed back to the supply compartment 9 via the regulated agent recovery unit 18 becomes larger due to some conditions at the doctor blade 16, a height of the developing agent at an downstream side of transport direction in the supply compartment 9 can become higher than a preferable height. If such phenomenon occurs, the height of the developing agent in the supply compartment 9 can become uneven, by which the supply screw 8 may not conduct an efficient transportation. Such condition may lead to an abnormal circulation of the developing agent, and may result in a degradation of the developing agent.

In an exemplary embodiment, if a height of the developing agent at a downstream of transport direction in the supply compartment 9 becomes higher than a preferable height, the developing agent overflows to the agitation compartment 10 from the supply compartment 9 through the height adjustment opening 145. Because the bottom height of the height adjustment opening 145 is set to a higher level compared to a given height of the developing agent in the supply compartment 9, the developing agent can be overflow from the supply compartment 9 to the agitation compartment 10, and the developing agent cannot overflow from the agitation compartment 10 to the supply compartment 9. With such configuration, the height of the developing agent in the supply compartment 9 can be maintained to a preferable level.

Furthermore, the developing agent that overflows from the height adjustment opening 145 is an agent not used for a developing operation, and thereby such developing agent has a preferable toner concentration, which is suitable for developing operation. Accordingly, even if the developing agent is supplied in the middle of the agitation compartment 10 through the height adjustment opening 145 from the supply compartment 9, a reduction of toner concentration or uneven distribution of toner concentration in the developing agent in the agitation compartment 10 cannot occur.

Furthermore, the height adjustment opening 145 can be provided at several portions as shown in FIG. 10, or can be provided as one opening portion (not shown) at a downstream of transport direction in the supply compartment 9.

With the above-described configuration having the height adjustment opening 145 in the separation wall 133 to overflow the developing agent from the supply compartment 9 to the agitation compartment 10, the height of the developing agent in the downstream side of transport direction in the supply compartment 9 can be maintained at a preferable level.

Hereinafter, a magnet position in the developing roller 5R is explained with reference to FIGS. 9A, 9B, 12, and 13.

Figure 12:
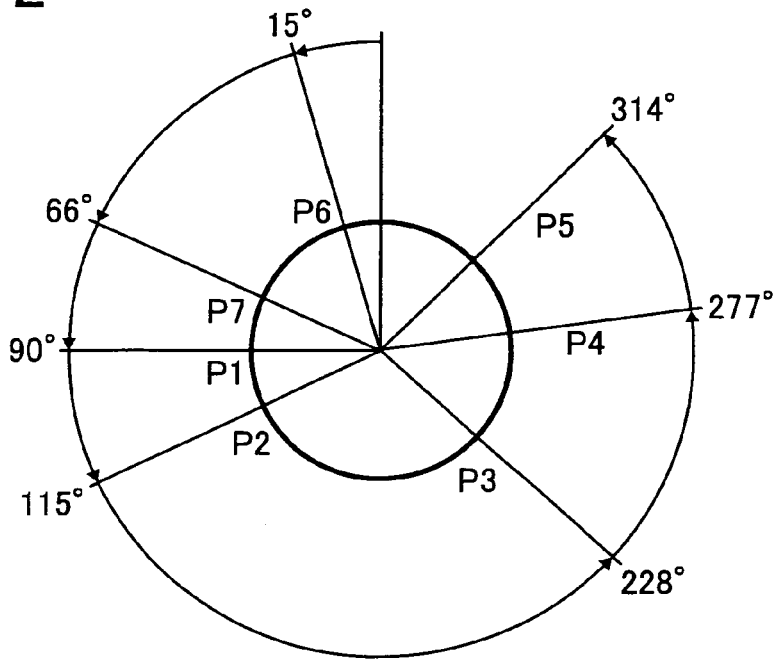
FIG. 12 is a schematic view explaining a positioning of each magnet in a magnet roller.
Figure 13:
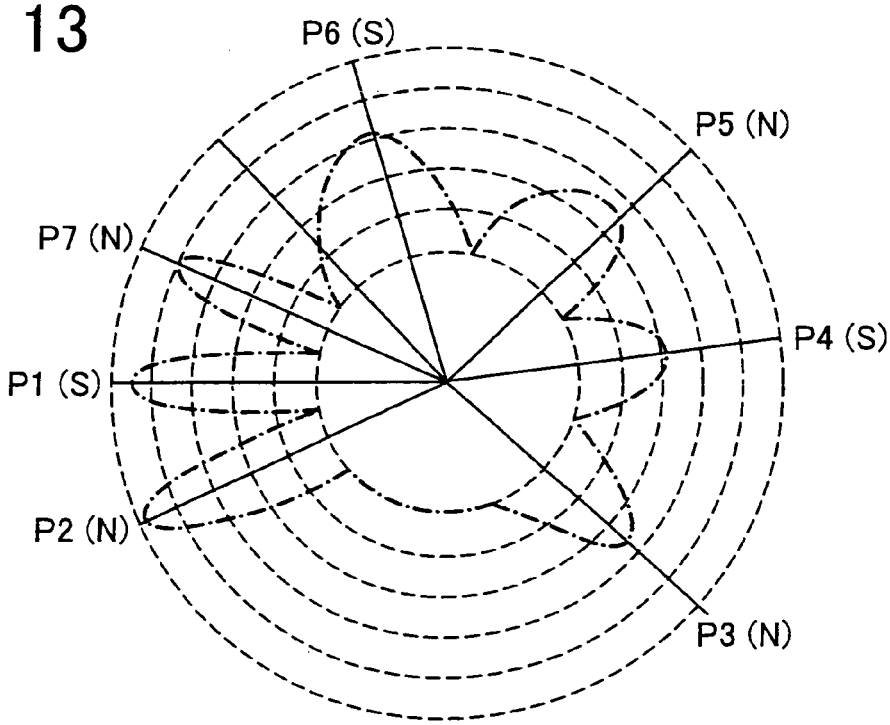
FIG. 13 is a circular chart of magnetic flux density distribution in normal line direction of a developing roller.

FIG. 12 is a schematic view explaining a positioning of each magnet in the magnet roller 5*a*. FIG. 13 is a circular chart of magnetic flux density distribution in normal line direction of the developing roller 5R.

As shown in FIGS. 9A and 12, the magnet P2 and magnet P3 are distanced apart from each other with a relatively longer interval, for example.

In FIG. 9A, a line M is assumed from a center of the developing roller 5R to a center of the recovery screw 6. A magnetic flux density on the surface of the developing roller 5R along the line M is set to 10 mT or less, for example.

When the used developing agent on the developing roller 5R comes around the line M, the used developing agent may not be effected by a magnetic force of the developing roller 5R substantially. As a result, the used developing agent may drop to the recovery compartment 7 with a centrifugal force of the developing roller 5R and a self weight of the developing agent, and can be recovered in the recovery compartment 7. If the magnetic flux density is too large (e.g., greater than 10 mT), the used developing agent may not drop to the recovery compartment 7 but still adhere on the developing roller 5R. Then, the used developing agent can be transported to an agent supplying position on the developing roller 5R, which faces the supply screw 8. If such used developing agent is used again for a developing operation, a toner concentration on the developing roller 5R may become lower or toner concentration on the surface of the developing roller 5R may become uneven.

In an example embodiment, an underside surface of the developing roller 5R is used as agent recovery area, and the recovery compartment 7 is provided under the agent recovery area of the developing roller 5R. With such a configuration, the used developing agent can be recovered in the recovery compartment 7 effectively because the self weight of the developing agent can contribute to the recovery of the developing agent in such configuration.

Furthermore, it is more preferable to set the magnetic flux density on the line M to "zero," where the line M is extended from the center of the developing roller 5R to the center of the recovery screw 6. When the magnetic flux density on the line M is set to "zero," and the used developing agent on the developing roller 5R comes around the line M, the used developing agent may not be effected by a magnetic force from the developing roller 5R, by which the used developing agent on the developing roller 5R can drop to the recovery compartment 7 more easily.

The developing agent recovered in the recovery compartment 7 is then transported by the recovery screw 6.

Figure 14B:
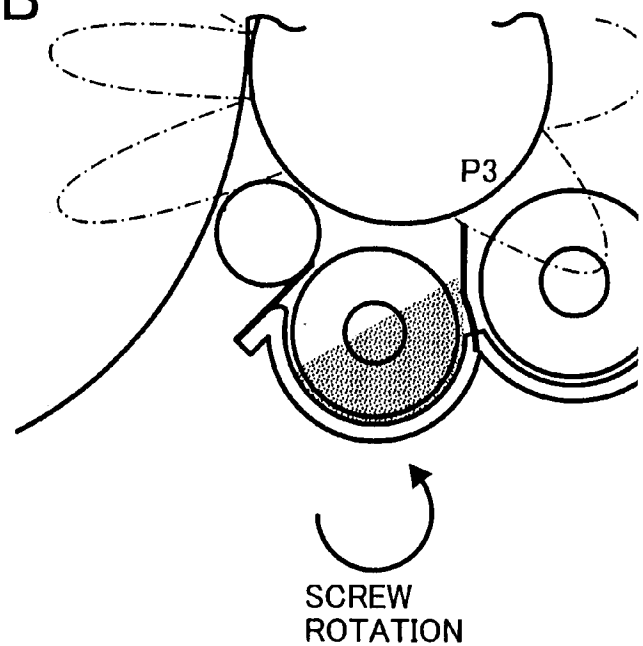
FIGS. 14A and 14B are cross-sectional views explaining a relationship between a rotational direction of a recovery screw and a slanting of developing agent in a recovery compartment.
Figure 14A:
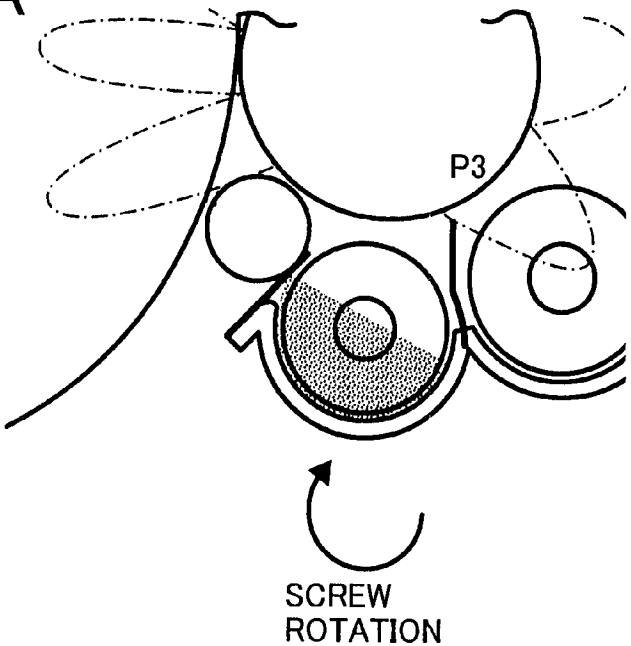

In the recovery compartment 7, a height of the recovered developing agent may not be uniform along the recovery compartment 7. The height of the developing agent in the recovery compartment 7 may become uneven as shown in FIGS. 14A and 14B depending on a rotational direction effect of the recovery screw 6. As shown in FIGS. 14A and 14B, the developing agent in the recovery compartment 7 may be slanted to either one of the photosensitive member 1 side or supply compartment 9 side in the recovery compartment 7. If the amount of the recovered developing agent in the recovery compartment 7 becomes too large, and the height of the recovered developing agent becomes too high, the slanted developing agent in the recovery compartment 7 may re-adhere onto the developing roller 5R with the magnetic force of the developing roller 5R, and such re-adhered developing agent may enter the supply compartment 9.

In an exemplary embodiment, as shown in FIG. 9A, a line M1 is assumed from the center of the developing roller 5R and a peripheral point 7*a* of the recovery compartment 7, and a line M2 is assumed from the center of the developing roller 5R and a peripheral point 7*b* of the recovery compartment 7, where the peripheral point 7*a* of the recovery compartment 7 is an edge of the recovery compartment 7, which is closer to the photosensitive member 1, and the peripheral point 7*b* of the recovery compartment is an edge of the recovery compartment 7, which is closer to the supply compartment 9.

In a sector area ϕ defined by the lines M1 and M2 as shown in FIG. 9A, a magnetic flux density on the surface of the developing roller 5R may be set to 10 mT or less, for example. With such a setting, even if an amount of the developing agent recovered in the recovery compartment 7 becomes larger, the recovered developing agent, which is slanted in the recovery compartment 7, may not re-adhere onto the developing roller 5R with the magnetic force effect of the developing roller 5R.

In order to set the magnetic flux density in the sector area ϕ defined by the lines M1 and M2 at 10 mT or less, the magnetic force of the magnets P2 and P3 can be adjusted so that the magnetic force of the magnets P2 and P3 do not substantially effect in the sector area ϕ.

In an example embodiment, the magnetic flux density of the each magnet can be set as in Table 1, where Table 1 corresponds to FIG. 13.

TABLE 1

| Magnet position | P1 | P2 | P3 | P4 | P5 | P6 | P7 |
|---|---|---|---|---|---|---|---|
| Polarity | S | N | N | S | N | S | N |
| Peak magnetic flux density (mT) | 90 | 95 | 55 | 42 | 45 | 65 | 80 |
| Angle position of magnet (degree) | 90 | 115 | 228 | 277 | 314 | 15 | 66 |
| Angle breadth for half-peak magnetic flux (degree) | 14.5 | 17.5 | 24 | 30 | 35 | 40 | 14.5 |

By setting the magnetic flux density for each magnet as shown in Table 1, the magnetic force of magnet P2 or magnet P3 may not have a substantial effect on the sector area ϕ shown in FIG. 9A.

If the developing roller 5R and the recovery compartment 7 are spaced apart by a greater distance, re-adhering of the developing agent, recovered in the recovery compartment 7, to the developing roller 5R with the magnetic force of the developing roller 5R can be prevented even if the magnetic flux density in the sector area ϕ is set at a greater value (e.g., greater than 10 mT).

However, if the developing roller 5R and recovery compartment 7 are spaced apart by a greater distance, the developing unit 500 can by increased in its overall size, which is not preferable from a viewpoint of miniaturization of the developing unit 500.

In an example embodiment, the developing roller 5R has a diameter of 35 mm, the recovery screw 6 has a diameter of 19 mm, and the distance from the center of the developing roller 5R to the center of the recovery screw 6 is 30.15 mm, for example.

When the magnetic flux density in the sector area ϕ is set to 10 mT or less under such a configuration, re-adhering of the recovered developing agent to the developing roller 5R can be prevented.

Furthermore, the magnetic flux density in the sector area ϕ is preferably set to "zero," by which re-adhering of the recovered developing agent to the developing roller 5R with the magnetic force of the developing roller 5R can be effectively prevented.

In an exemplary embodiment, the magnetic flux density is set to 10 mT or less by distancing the magnet P2 and magnet P3 from each other. However, other methods can be used as discussed below for setting the magnetic flux density to 10 mT or less.

Figure 9B:
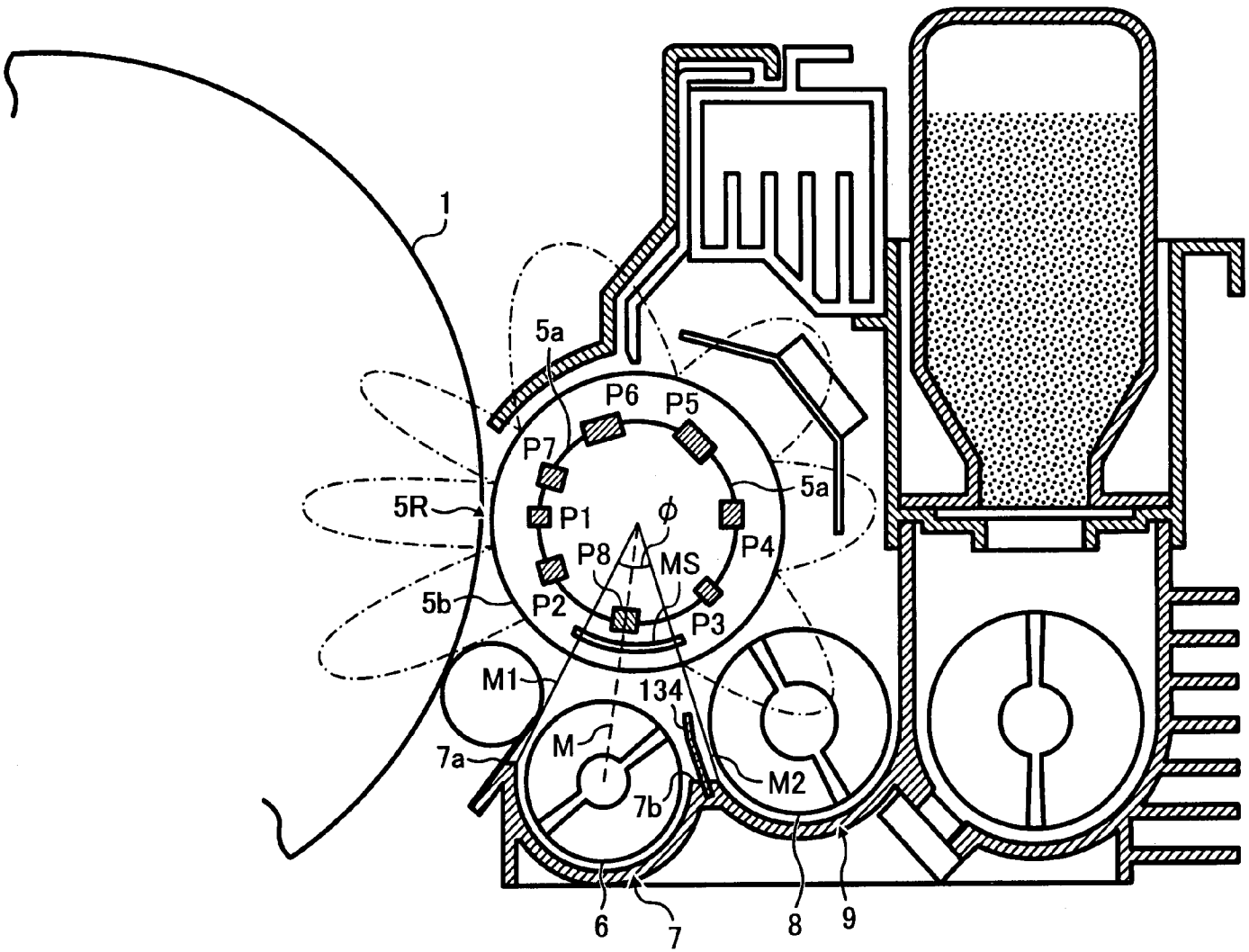
FIG. 9B is a view explaining a magnetic flux density in a normal line direction of a developing roller, in which a magnetic shield is provided.

For example, as shown in FIG. 9B, a magnetic shield MS can be provided between the developing sleeve 5*a* and magnet roller 5*b* while a position of the magnetic shield MS faces the recovery compartment 7. The magnetic shield MS can be provided between the developing sleeve 5*a* and magnet roller 5*b* because of a space between the developing sleeve 5*a* and magnet roller 5*b*. Even if a magnet P8 can be provided between the magnets P2 and P3 of the developing roller 5R as shown in FIG. 9B, a magnetic flux from the magnet P8 can be effectively shielded by the magnetic shield MS. Accordingly, the magnetic flux density in the sector area ϕ can be set to 10 mT or less.

Furthermore, a repelling magnetic force can be set between the magnet P2 and magnet P3 so that the magnetic force of the magnet P2 and magnet P3 (e.g., N pole) may not effect the sector area ϕ.

Furthermore, a magnetic shield can be put on the separation wall 134 to shield the magnetic force effect of magnet P3 to the sector area ϕ.

Furthermore, the recovery screw 6 is preferably rotated in one direction so that the recovered developing agent can be slanted to the photosensitive member 1 side in the recovery compartment 7 in a greater degree. Under such a condition, some recovered developing agent existing in the photosensitive member 1 side in the recovery compartment 7 may re-adhere to the developing roller 5R. However, such re-adhered developing agent may not be transported to the agent supplying position for the developing roller 5R, at which the supply screw 8 faces the developing roller 5R and supplies the developing agent to the developing roller 5R, but such re-adhered developing agent may drop in the recovery compartment 7 with a rotation of the developing roller 5R because such re-adhered developing agent on the developing roller 5R pass through the above-mentioned sector area ϕ not having substantial magnetic force effect.

If the recovered developing agent can be slanted to the supply compartment 9 side in the recovery compartment 7 in a greater degree, some recovered developing agent existing in the supply compartment 9 side in the recovery compartment 7 may re-adhere to the developing roller 5R. In this case, because such re-adhered developing agent comes to the agent supplying position for the developing roller 5R with a shorter distance, such re-adhered developing agent may not drop in the recovery compartment 7 with a rotation of the developing roller 5R. Accordingly, the recovery screw 6 is preferably rotated in one direction so that the recovered developing agent in the recovery compartment 7 can be slanted to the photosensitive member 1 side in the recovery compartment 7 in a greater degree.

Specifically, as shown in FIG. 14A, a height of recovered developing agent in the recovery compartment 7 becomes higher at the photosensitive member 1 side in the recovery compartment 7, and a height of recovered developing agent in the recovery compartment 7 becomes lower at the supply compartment 9 side in the recovery compartment 7. Under such a condition, the recovered developing agent at the supply compartment 9 side in the recovery compartment 7 can be substantially distanced from the developing roller 5R, and may not be effected by the magnetic force of the developing roller 5R, by which the re-adhering of the recovered developing agent to the developing roller 5R may less likely to occur.

Some recovered developing agent at the photosensitive member 1 side in the recovery compartment 7, which is relatively closer to the developing roller 5R, may re-adhere to the developing roller 5R with the magnetic force of the developing roller 5R. However, such re-adhered developing agent may drop in the recovery compartment 7 when such re-adhered developing is transported on the developing roller 5R because the developing roller 5R pass through the above-mentioned sector area ϕ not having substantial magnetic force effect before the developing roller 5R comes to the agent supplying position. As a result, the recovered developing agent may not be transported to the agent supplying position, defined by the supply screw 8 and the developing roller 5R. Therefore, the developing agent recovered in the recovery compartment 7 may not be directly supplied to the agent supplying position, defined by the supply screw 8 and the developing roller 5R.

A slanting condition of the developing agent in the recovery compartment 7 can be set by a rotational direction of the recovery screw 6. In an exemplary embodiment shown in FIG. 14A, the recovery screw 6 is rotated in one direction (e.g., clockwise direction in FIG. 14A) so that a larger amount of the developing agent in the recovery compartment 7 can be slanted in the photosensitive member 1 side in the recovery compartment 7.

Figure 15:
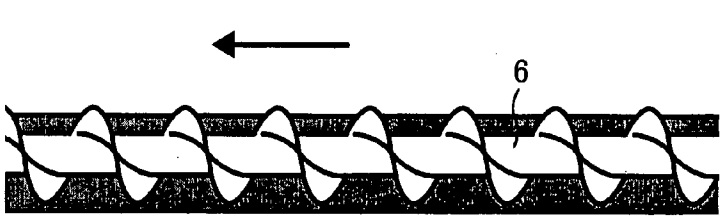
FIG. 15 is a view explaining a winding direction of a blade on a recovery screw.

The recovery screw 6 has a blade wound around a shaft of the recovery screw 6 as shown in FIG. 15. With such blade, the recovery screw 6 can transport the recovered developing agent in a direction shown by an arrow in FIG. 15.

Figure 16:
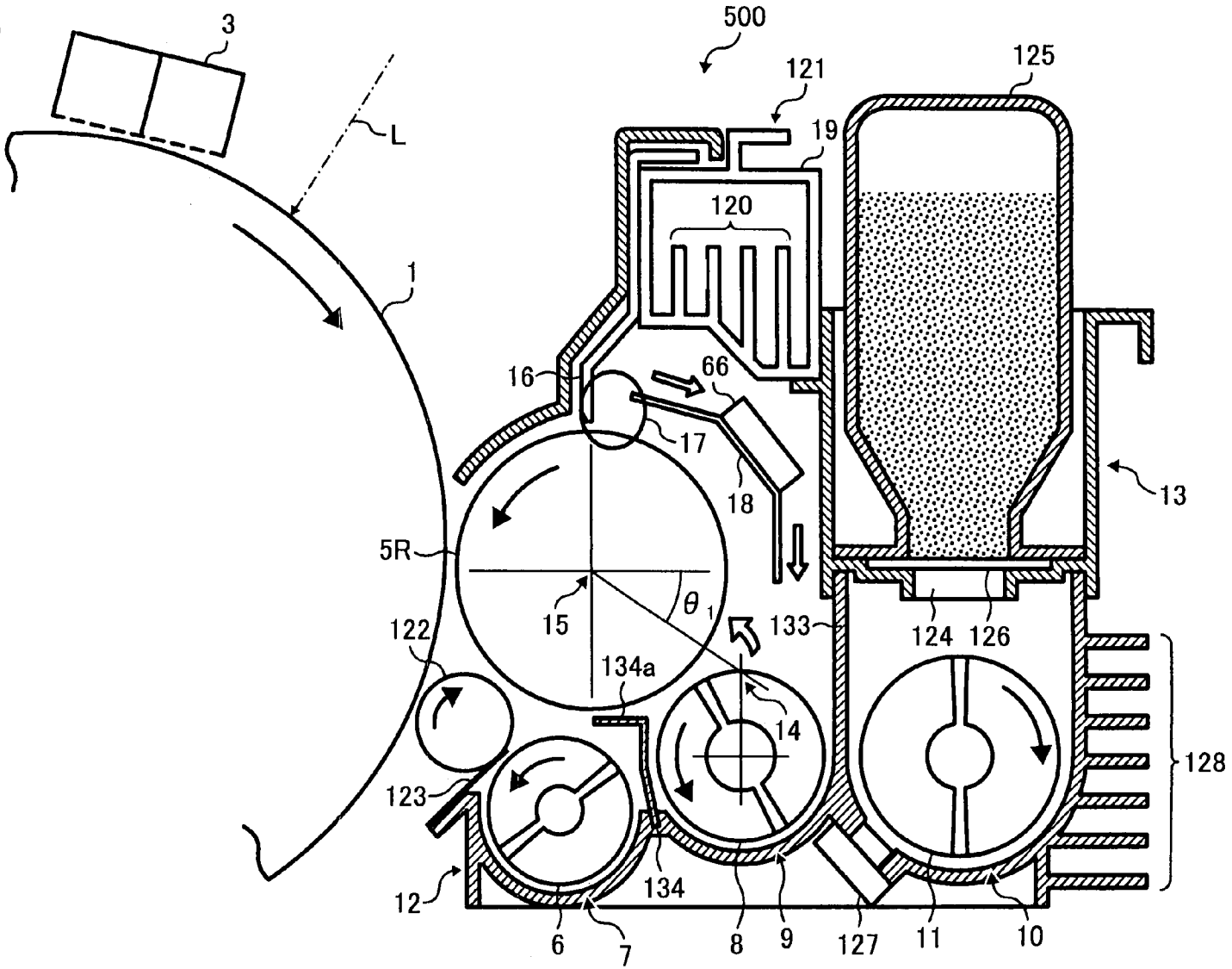
FIG. 16 is a schematic view of a developing unit having a roof on a separation wall.

Furthermore, as shown in FIG. 16, the separation wall 134, which separates the recovery compartment 7 and supply compartment 9, can be provided with a roof 134*a*. The roof 134*a* can be provided to the separation wall 134 to prevent a re-adhering of the recovered developing agent in the recovery compartment 7 to the developing roller 5R from the supply compartment 9 side in the recovery compartment 7.

Furthermore, a gap between the roof 134*a* and developing roller 5R is preferably set to a smaller value. For example, the gap between the roof 134*a* and developing roller 5R can be set to smaller than a diameter of the developing agent. With such configuration, developing agent re-adhered to the developing roller 5R, or developing agent not dropped to the recovery compartment 7 by the centrifugal force of the developing roller 5R and self weight of developing agent, may contact an edge of the roof 134*a*, by which the developing agent may drop to the recovery compartment 7. As a result, the developing agent re-adhered to the developing roller 5R, or developing agent not dropped to the recovery compartment 7 by the centrifugal force of the developing roller 5R and self weight of developing agent, may not be transported to the agent supplying position defined by the supply screw 8 and developing roller 5R. Furthermore, the roof 134*a* can prevent a re-adhering of the recovered developing agent to the developing roller 5R from the supply compartment 9 side in the recovery compartment 7.

If the roof 134*a* is provided on the separation wall 134, the recovery screw 6 is preferably rotated to one direction so that the recovered developing agent can be slanted to the supply compartment 9 side in the recovery compartment 7 in a greater degree. As shown in FIG. 14B, when the recovery screw 6 is rotated in one direction (e.g., counter-clockwise direction in FIG. 14B), the recovered developing agent transported by the recovery screw 6 in the recovery compartment 7 can be slanted to the supply compartment 9 side in the recovery compartment 7 in greater degree.

Specifically, as shown in FIG. 14B, a height of recovered developing agent in the recovery compartment 7 becomes lower at the photosensitive member 1 side in the recovery compartment 7, and a height of recovered developing agent in the recovery compartment 7 becomes higher at the supply compartment 9 side in the recovery compartment 7. If the height of the recovered developing agent at the photosensitive member 1 side in the recovery compartment 7 becomes lower, the recovered developing agent at the photosensitive member 1 side in the recovery compartment 7 may less likely to be effected by the magnetic force of the developing roller 5R, by which re-adhering of the recovered developing agent to the developing roller 5R can be suppressed.

The recovered developing agent at the supply compartment 9 side in the recovery compartment 7 may more likely to be effected by the magnetic force of the developing roller 5R because the height of the recovered developing agent at the supply compartment 9 side in the recovery compartment 7 becomes higher. However, the roof 134*a* can prevent re-adhering of the recovered developing agent to the developing roller 5R. Accordingly, re-adhering of the recovered developing agent to the developing roller 5R at the supply compartment 9 side in the recovery compartment 7 can be suppressed.

If the recovered developing agent accumulates in the recovery compartment 7 with a larger volume, the height of the recovered developing agent in the recovery compartment 7 becomes higher, and a distance between an upper portion of the recovered developing agent and developing roller 5R may become smaller. Under such a condition, re-adhering of the recovered developing agent to the developing roller 5R may more likely to occur with the magnetic force of developing roller 5R.

Furthermore, if the recovered developing agent accumulates in the recovery compartment 7 with too much volume, the recovered developing agent may spillover from the recovery compartment 7. Under such a condition, the recovered developing agent may contact the developing roller 5R, and the recovered developing agent may be transported to the agent supplying position with friction force with the developing roller 5R.

Therefore, in an exemplary embodiment, the recovery screw 6 is preferably controlled with a given rotation speed so that the recovered developing agent may not spillover from the recovery compartment 7.

A spillover of the recovered developing agent from the recovery compartment 7 can be prevented by setting the following conditions. For example, a rotation speed of the recovery screw 6 is set to a value, which satisfies a following relationship. For the sake of explanation, two kinds of amount are assumed. A first amount is defined as an amount of the developing agent to be actually received per unit length of the recovery compartment 7 at the downstream side of the recovery compartment 7. A second amount is defined as an amount of the developing agent, which can be held per unit length of the recovery compartment 7 at the downstream side of the recovery compartment 7.

The rotation speed of the recovery screw 6 is set to a value, which can satisfy a following relationship:

$$\text{Second amount} \geqq \text{First amount}.$$

The first amount can be determined with an amount of developing agent recovered to the recovery compartment 7 from the developing roller 5R, and a moving speed of the developing agent in a longitudinal direction of the recovery compartment 7. The second amount can be determined with an area of the recovery screw 6 and bulk density of the developing agent.

In an exemplary embodiment, following conditions are set: the recovery screw 6 has a radius r (mm), a rotation speed R (rpm), and a blade pitch l (mm); the developing agent has a bulk density of d (kg/m$^3$); the developing roller 5R has a line velocity of V (m/s), and a longitudinal length of L (mm); the developing agent is carried up to the developing roller 5R with an amount of ρ (kg/m$^2$) per unit area of developing roller 5R after doctoring the developing agent. Then, a following equation (1) can be set for the above-explained relationship for the first amount and second amount of developing agent:

$$(\pi r^2 d)\beta \geqq 60(VL\rho)/(Rl\alpha). \quad (1)$$

The left side of equation (1) defines the second amount, and the right side of equation (1) defines the first amount, where β is a constant calculated from an experiment in which a virtual cylinder having a diameter of the recovery screw 6 is assumed, a total volume Vt of the virtual cylinder is calculated based on the diameter of the recovery screw 6, a volume Vc of the recovery screw 6 is subtracted from the total volume of the virtual cylinder. β is a ratio of a volume of (Vt−Vc) and total volume (Vt) of the virtual cylinder.

The upper right side of the equation (1) defines a total amount of developing agent to be received in the recovery compartment 7 per unit time. The lower right side of the equation (1) defines a moving distance of the developing agent per unit time in a longitudinal direction of the recovery compartment 7, where α is a constant calculated from an experiment in which α is a ratio of moving speed of developing agent against a moving speed of blade of the recovery screw 6. By dividing the upper right side of the equation (1) with the lower right side of the equation (1), an amount of developing agent to be introduced into the downstream side of the recovery compartment 7 per unit length can be calculated.

If the relationship of "Second amount≧First amount" can be satisfied, a spillover of the developing agent from the recovery compartment 7 can be prevented, where the first amount is defined as an amount of the developing agent to be actually received per unit length of the recovery compartment 7 at the downstream side of the recovery compartment 7, and the second amount is defined as an amount of the developing agent, which can be held per unit length of the recovery compartment 7 at the downstream side of the recovery compartment 7.

In an exemplary embodiment, the developing unit has a constant α of 0.6 and a constant β of 0.75, for example.

The equation (1) can be changed to a following equation (2), which obtains a rotation speed R of the recovery screw 6 that can satisfy relationship of "Second amount≧First amount:"

$$R \geqq (60/\alpha(( )\times(VL(/dr21). \quad (2)$$

From equation (2), a rotation speed R of the recovery screw 6, which can prevent spillover of the developing agent from the recovery compartment 7, can be computed.

Figure 17:
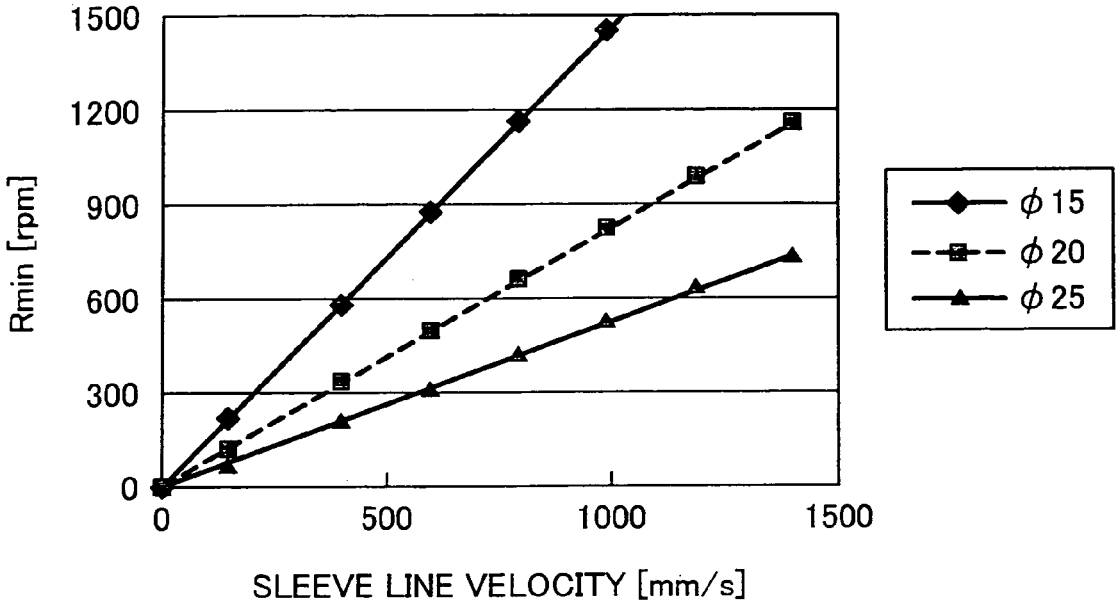
FIG. 17 is a graph explaining a relationship between a line velocity of a developing sleeve and a rotation speed of a recovery screw.

FIG. 17 is a graph explaining a relationship between a line velocity of a developing sleeve and a rotation speed R of recovery screw 6, where the rotation speed R of the recovery screw 6 is calculated by inputting parameters to the equation (2). FIG. 17 shows a relationship between a line velocity of developing sleeve and a rotation speed R of recovery screw 6 by inputting 15, 20, and 25 mm as a diameter of the recovery screw 6.

From the equation (2), a rotation speed R of the recovery screw 6, which can prevent spillover of the recovered developing agent from the recovery compartment 7, can be obtained.

Hereinafter, a characteristic of the developing agent for use in an exemplary embodiment is explained.

The developing agent includes a magnetic carrier, where the magnetic carrier preferably has a volume average particle diameter of 20 to 60 (m, for example.

With an employment of the magnetic carrier having a smaller volume average particle diameter (e.g., 60 (m or less), the developing unit 500 can reduce an amount to be carried up to the developing roller 5R while avoiding a degradation of developability.

If the magnetic carrier having a smaller volume average particle diameter is used, a carrier-to-carrier space becomes smaller, by which magnetic brushes formed on a developing area of the developing roller 5R can have a greater density per unit area on the developing roller 5R. Accordingly, the developing unit 500 can conduct an effective developing operation with a smaller amount of developing agent. Therefore, the developing unit 500 can reduce an amount of developing agent to be circulated in the developing unit 500, by which the developing agent can be stably supplied to the developing roller 5R for a longer period of time. Furthermore, the developing agent can be stably transported in the recovery compartment 7 without spillover.

If the magnetic carrier has too large particle diameter (e.g., 60 μm), the developing agent may be more likely to spillover from the recovery compartment 7, by which a stable circulation of the developing agent in the developing unit 500 may not be conducted.

If the magnetic carrier has too small particle diameter (e.g., 20 μm), the magnetic carrier agent may be more likely to stick on the photosensitive member 1, and may be more likely to spatter in the developing unit 500, which are not favorable phenomenon.

The volume average particle diameter of magnetic carrier can be measured with Microtrac® Particle size Analyzer SRA type (available from NIKKISO CO., LTD.). The measurement can be conducted in a range of 0.7 to 125 μm.

Hereinafter, a characteristic of the toner for use in an exemplary embodiment is explained.

The toner for use in an exemplary embodiment preferably has a volume average particle diameter of 3 to 8 μm, for example.

With an employment of the toner having a smaller volume average particle diameter (e.g., 8 μm or less), a toner-to-toner space becomes smaller, by which a bulk density of the developing agent can be increased. Therefore, even if a fluidity of developing agent may change, the developing agent can be stably supplied from the supply compartment 9 Furthermore, the developing agent can be stably transported in the recovery compartment 7 without spillover. Furthermore, because the toner for use in an example embodiment has a sharper profile for particle diameter distribution, the developing agent has a good fluidity, by which a circulation of developing agent can be stably conducted for a longer period of time. Furthermore, because the toner-to-toner space becomes smaller in an example embodiment, a toner density in an image becomes greater. Accordingly, an amount of toner to be adhered on an image and a toner pile height can be reduced.

The toner preferably has the volume average particle diameter of 3 to 8 μm for reproducing an image with a higher resolution (e.g., reproducing tiny dot) such as 600 dpi (dot per inch) or greater. If the volume average particle diameter of the toner is set to 3 to 8 μm, a reproducibility of tiny dot may be improved because such toner includes toner particles having an effectively smaller diameter. Accordingly, a higher quality image can be produced in a stable manner.

If the volume average particle diameter Dv of the toner becomes too small (e.g., 3 μm or less), unfavorable phenomenon such as degradation of transferability and degradation of cleaning-ability of blade may be more likely to occur.

If the volume average particle diameter Dv of the toner becomes too large (e.g., 8 μm or more), a toner image may have a larger toner pile height, by which spattering at character and line in an image may be more likely to occur.

Furthermore, the toner preferably has a ratio (Dv/Dn) of 1.00 to 1.40, where Dv is the volume average particle diameter and Dn is the number average particle diameter.

When the ratio of (Dv/Dn) becomes closer to 1.00, the toner has a sharper profile for particle diameter distribution. If the toner has a smaller particle diameter and a sharper profile for particle diameter distribution, the toner can be charged uniformly, by which a higher quality image without fogging can be obtained. Furthermore, such toner can improve transferability in an electrostatic transfer method.

The diameter (e.g., volume average particle diameter and number average particle diameter) distribution of toner particles can be measured with a measurement device using the Coulter Principle. For example, the diameter distribution of the toner particles may be measured with COULTER COUNTER TA-II or COULTER Multisizer II (manufactured by Beckman Coulter, Inc.).

Each sample can be prepared as discussed below for measurement of the diameter distribution of toner particles.

At first, an electrolytic solution including purified water of 100 to 150 ml and first grade NaCl is prepared as approximately 1% NaCl solution (sodium solution), and such 1% NaCl solution is poured in a vessel. Isoton® II (a balanced electrolytic solution manufactured by Beckman Coulter, Inc.) can used as electrolytic solution, for example.

Then, 0.1 to 5 ml of surfactant (preferably alkylbenzene sulfonic acid salt) is added to the electrolytic solution as dispersing agent. And then, a sample of 2 to 20 mg is added to the solution. The mixed solution is dispersed for one to three minutes by an ultrasonic dispersion apparatus. Then the volume distribution and numbers distribution are computed by measuring volume and numbers of toner particles using an aperture of 100 μm.

The volume average particle diameter Dv and the number average particle diameter Dn can be obtained from volume distribution and numbers distribution of toner particles.

The measurement can be conducted with thirteen channels: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm. The measurement is conducted for toner particles having a particle diameter of 2.00 μm to less than 40.30 μm.

In an example embodiment, the toner preferably has a first shape factor SF-1 set from 100 to 180, and a second shape factor SF-2 set from 100 to 180. The first and second shape factors SF-1 and SF-2 are parameters for expressing shape of toner, which are widely used in a field of powder technology.

Figure 18:
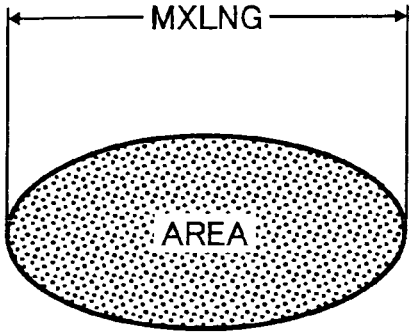
FIG. 18 is a schematic view for explaining shape factor SF-1 of a toner particle.

As illustrated in FIG. 18, the first shape factor SF-1 represents the degree of the roundness of toner particle and is defined by the following equation (3):

$$\text{SF-1}=\{(MXLNG)^2/(\text{AREA})\}\times(100\pi/4), \quad (3)$$

where MXLNG represents a diameter of the circle circumscribing the image of a toner particle, which image is obtained by observing the toner particle with a microscope, and AREA represents the area of the image.

When the first shape factor SF-1 is 100, the toner particle has a true spherical form. In this case, toner particles contact the other toner particles and an image carrying member (e.g., photosensitive member) at one point. Therefore, the adhesion of the toner particles to the other toner particles or the image carrying member decreases, resulting in an increase of the fluidity of the toner particles and the transferability of the toner.

When the first shape factor SF-1 is too large, the toner particles have irregular forms, and thereby the toner has poor developability and poor transferability.

Figure 19:
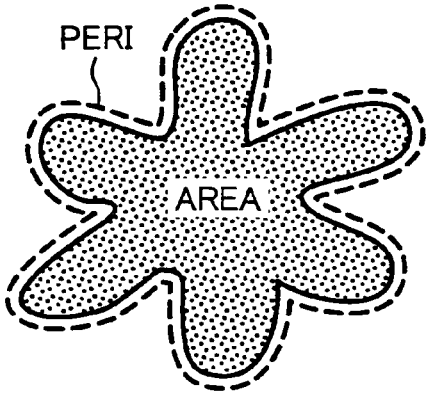
FIG. 19 is a schematic view for explaining shape factor SF-2 of a toner particle.

As illustrated in FIG. 19, the second shape factor SF-2 represents the degree of the concavity and convexity of a toner particle, and is defined by the following equation (4):

$$\text{SF-2}=\{(PERI)^2/(\text{AREA})\}\times(100/4\pi), \quad (4)$$

where PERI represents the peripheral length of the image of a toner particle observed by a microscope, and AREA represents the area of the image.

When the second shape factor SF-2 approaches 100, the toner particles have a smoother surface (i.e., the toner has few concavity and convexity). It is preferable for a toner to have a slightly roughened surface to obtain good clean-ability of the toner.

However, when the second shape factor SF-2 is too large (i.e., the toner particles are seriously roughened), a toner scattering (i.e., toner particles are scattered around a toner image) may occur, which results into a deterioration of the toner image qualities.

The first and second shape factors SF-1 and SF-2 are determined by the following method:

(1) 100 particles of a toner are photographed using a scanning electron microscope (Field Emission Scanning Electron Microscope S-800 manufactured by Hitachi Ltd.);

(2) Photographed images of 100 toner particles are analyzed using an image analyzer (LUZEX 3 manufactured by Nireco Corp.) to determine the SF-1 and SF-2 with MXLING, AREA, and PERI; and (3) The shape factors SF-1 and SF-2 are determined as average value of 100 toner particles.

When the SF-1 and SF-2 becomes closer and closer to 100, the toner particle becomes closer to a true spherical form. In this case, the toner particles contact the other toner particles and the image carrying member (e.g., photoconductive member) at one point. Therefore, the adhesion of the toner particles to the other toner particles and the image carrying member (e.g., photoconductive member) may decrease, resulting in increase of the fluidity of the toner particles. Accordingly, the developing agent for use in an example embodiment can have an improved agent circulation property, by which the developing agent can be stably circulated in the developing agent 500 for a longer period of time.

Furthermore, the toner particles contact the image carrying member (e.g., photoconductive member) at one point, by which the adhesion of the toner particles to the image carrying member (e.g., photoconductive member) may decrease, which results in an increase of the transferability of toner and improvement of image quality.

Furthermore, when the shape factors SF-1 and SF-2 become too large (e.g., when SF-1 or SF-2 exceeds 180), the toner particles have irregular forms and thereby the toner has poor fluidity, which is not preferable for circulating the developing agent. Furthermore, such toner has poor transferability, which is also not preferable.

The toner for use in an exemplary embodiment includes a fine particle added on a surface of toner particle. The fine particle has an average primary particle diameter of 50 to 500 nm, and a bulk density of 0.3 mg/cm$^3$ or more, for example. The fine particle can be used as a fluidity improving agent. For example, the fine particle includes a silica particle having an average primary particle diameter of 10 to 30 nm, and a bulk density of 0.1 to 0.2 mg/cm$^3$.

As for the developing agent used in an exemplary embodiment, if such fine particle is added on a surface of toner particle, one toner particle may contact another toner particle or an image carrying member by interposing such fine particle therebetween when contacting each other, by which a buffer space can be set between objects (e.g., toner particle to toner particle, toner particle to image carrying member).

Furthermore, such a fine particle may uniformly contact other objects such as toner particles, an image carrying member, and a transport belt with a significantly smaller contact area. Accordingly, an adhesion of toners to other objects can be made smaller. For example, if such toner is used for image forming operation, an unfixed toner image, which may contact a transport belt when a transfer sheet is transported by a transport belt to a fixing nip, may be less likely to adhere on the transport belt, by which a disturbance in a to-be-produced image may be suppressed.

Furthermore, the fine particle may increase developability and transferability of the toner, and dot reproducibility, by which a higher quality image can be stably obtained.

Furthermore, the fine particle may function as a buffer particle, where such buffer particle may reduce friction between toner particle and image carrying member such as photoconductive member. Such function is favorable from a viewpoint of reducing stresses to be applied to the image carrying member, and may resultantly reduce abrasion or damages on the image carrying member.

The fine particles may not submerge in a toner particle even when a higher stress (e.g., higher pressure) is applied when a cleaning blade cleans the image carrying member (e.g., photoconductive member).

Because the fine particle is a relatively hard particle, such a fine particle may submerge in a toner particle, by which the fine particle may not exert its function. Therefore, an adhesion of fine particle to toner particle is controlled so that the fine particle may not submerge in the toner particles, by which a toner property can be maintained at a stable level for a longer period of time.

Furthermore, the fine particle, which may drop off from the surface of the toner particle, may adhere and accumulate on an edge on the cleaning blade because the fine particle is smaller in size and stronger in adhesion compared to toner particle, where such accumulation is referred as "dam effect". With such "dam effect," the cleaning blade can effectively prevent a pass-through of toner particles from the blade.

Such property of fine particle can reduce stress to be applied to the toner particle, by which the toner particle may not be fricitioned with the image carrying member such as photosensitive member.

Therefore, a toner filming, which may be caused by a low rheology component (e.g., lower molecular weight resin) included in the toner, can be reduced when a high speed fixing is conducted.

The fine particle preferably has a smaller particle diameter from 50 to 500 nm for an average primary particle diameter, where the average primary particle diameter is an average diameter of particles when particles are not aggregated.

If such fine particles having a smaller average primary particle are used, a good cleaning-ability and good fluidity of toner may be obtained.

Furthermore, even if the fine particle contaminate the magnetic carrier (e.g., fine particle may stick on a surface of the magnetic carrier), such a phenomenon may not seriously affect the developability of toners when the above-mentioned fine particles are used as additives for toner particles.

Accordingly, a fluidity of toner and chargeability of magnetic carrier may not be changed significantly over the time when such a fine particle is used, by which a higher image quality may be obtained over the time.

The fine particle has an average primary particle diameter of 50 to 500 nm, and preferably 100 to 400 nm.

If the average particle diameter of the fine particles is too small (e.g., less than 50 nm), the fine particle may drop into concave portions on a toner surface, by which fine particle may not be exposed from the toner surface. If the fine particle may drop into the concave portions, such fine particle may not effectively function as a buffer particle.

If the average particle diameter of the fine particle is too large (e.g., greater than 500 nm), a cleaning-ability of toners on a surface of the photoconductive member may degrade. Specifically, if such fine particle having a larger diameter exists between a surface of a photoconductive member and a cleaning blade, the toner particle may not be removed by the cleaning blade because such fine particle may have a contact area, which is similar to the toner particle, and such condition may lead to a passing-off the toner particle at the cleaning blade. Accordingly, a cleaning-ability of toners may degrade.

If the bulk density of the fine particle is too small (e.g., less than 0.3 mg/cm$^3$), the toner particle and fine particle may unfavorably spatter and adhere, by which the fine particle may degrade its functions such as buffer particle and dam effect for clean-ability of toner, although such fine particle may improve fluidity of tone particle somewhat.

The fine particle includes inorganic compounds and organic compounds as noted below.

The inorganic compounds include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, and $SrTiO_3$, and preferably includes $SiO_2$, $TiO_2$, $Al_2O_3$. These inorganic compounds may be treated by coupling agents, hexamethyldisilazane, dimethyldichlorosilane, and octyl-trimethoxysilane, for example, to add hydrophobic property to inorganic compounds.

The organic compounds include thermoplastic and thermosetting resin such as vinyl resin, polyurethane resin, epoxy resin, polyester resin, polyamide resin, polyimide resin, silicone resin, phenolic resin, melamine resin, urea resin, aniline resin, ionomer resin, polycarbonate resin, etc. These resins can be used alone or in combination.

Suitable resins for use as the fine particles include known resins, which can form an aqueous dispersion. Among these resins, vinyl resin, polyurethane resin, epoxy resin, and polyester resin are preferably used because an aqueous dispersion including fine spherical resin particles can be easily prepared. These resins can be used alone or in combination.

Specific examples of the vinyl resin include homopolymers or copolymers obtained from one or more vinyl monomers such as styrene-meth)acrylate ester copolymers, styrene-butadiene copolymers, (meth)acrylic acid-acrylate ester copolymers, styrene-acrylonitrile copolymers, styrene-maleic anhydride copolymers, and styrene-(meth)acrylic acid copolymers, etc.

The bulk density of the fine particles is defined by the following equation (5):

$$\text{Bulk density (g/cm}^3\text{)=fine particle amount (g/100 ml)/100.} \quad (5)$$

The amount of fine particles can be measured as below. Fine particles of 100 ml are poured into a 100 ml-graduated cylinder without giving vibration to the graduated cylinder. A weight difference before and after pouring fine particles in the graduated cylinder is measured as amount of fine particles.

The fine particles can be added and adhered on the toner surface by a method such as mixing toner particles and fine particles with a mixing machine, or dispersing toner particles and fine particles uniformly in a liquid with a surfactant and drying the resultant particles.

In the above-described embodiment, the image forming apparatus 1000 includes the above-discussed developing unit, therefore the image forming apparatus 1000 can produce a higher quality image over the time, where the higher quality image may not have a low image density area and uneven image, for example.

Furthermore, the image forming apparatus 1000 according to an exemplary embodiment includes the first intermediate transfer belt and the second intermediate transfer belt, where the first intermediate transfer belt transfers the first image to the first face of the transfer sheet, and the second intermediate transfer belt transfers second image to the second face of the transfer sheet, by which two images can be formed on both faces of transfer sheet.

Compared to an image forming apparatus that forms one image on a first face of a transfer sheet, inverts the face of the transfer sheet, and then forms another image on a second face of a transfer sheet, the image forming apparatus 1000 according to an exemplary embodiment can form two images on both faces of transfer sheet in a shorter period of time. Accordingly, the image forming apparatus 1000 according to an exemplary embodiment can improve productivity of double face printing operation.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2005-217580 filed on Jul. 27, 2005 in the Japan Patent Office, the entire contents of which is hereby incorporated by reference herein.

What is claimed is:

1. A developing unit for use in an image forming apparatus including an image carrying member, the developing unit comprising:

an agent carrying member configured to carry a two-component developing agent having a magnetic carrier and a toner thereon, and configured to rotate to supply the toner to a latent image formed on the image carrying member at a position where the agent carrying member faces the image carrying member, the agent carrying member including a plurality of magnets therein to generate a magnetic flux density over the agent carrying member;

a supply compartment configured to transport the developing agent to be supplied to the agent carrying member;

a supply screw, included in the supply compartment, configured to supply the developing agent to the agent carrying member while transporting the developing agent in a longitudinal direction of the supply compartment;

a recovery compartment, provided under the agent carrying member, configured to recover the developing agent dropped from the agent carrying member after the toner is supplied to the image carrying member from the agent carrying member;

a recovery screw, included in the recovery compartment, configured to transport the recovered developing agent in a longitudinal direction of the recovery compartment, wherein the recovery screw and supply screw transport the developing agent in a same direction;

an agitation compartment configured to receive the developing agent from the supply compartment, which is not supplied to the agent carrying member for developing operation and transported to a most downstream portion of the supply compartment, and the recovered developing agent from the recovery compartment, which is transported to a most downstream portion of the recovery compartment; and an agitation screw, included in the agitation compartment, configured to agitatingly transport the developing agent in a longitudinal direction of the agitation compartment to supply agitated developing agent to the supply compartment, wherein the agitation screw and supply screw transport the developing agent in opposite directions to each other, wherein the recovery compartment, supply compartment, and agitation compartment are provided side-by-side in a substantially horizontal direction, and wherein the magnetic flux density on a surface of the agent carrying member in a normal line direction, extended from a center of the agent carrying member to a center of the recovery screw, is set to 10 mT or less.

2. The developing unit according to claim 1, wherein the developing unit includes a sector area having a magnetic flux density of 10 mT or less in the normal line direction of the agent carrying member, wherein the sector area is defined by the center of the agent carrying member, and first and second lines extending from the center of the agent carrying member, the first line is extended from the center of the agent carrying member to a first edge at the image carrying member side of the recovery compartment, and the second line is extended from the center of the agent carrying member to a second edge at the supply compartment side of the recovery compartment.

3. The developing unit according to claim 1, wherein the recovery screw is rotated with a speed defined by an equation of:

$$R \geqq (60/\alpha\beta\pi)\times(VL\rho/dr^2l),$$

so that the developing agent is transported in the recovery compartment without spillover, wherein the rotation speed of the recovery screw is R (rpm), the agent carrying member has a line velocity of V (m/s), the agent carrying member has a longitudinal length of L (mm), the developing agent is carried up to the agent carrying member with an amount of $\rho$ (kg/m$^2$), the developing agent has a bulk density of d (kg/m$^3$), the recovery screw has a radius of r (mm) and a pitch interval of l (mm), $\alpha$ is 0.60, and $\beta$ is 0.75.

4. The developing unit according to claim 1, further comprising a separation wall configured to separate the recovery compartment and supply compartment.

5. The developing unit according to claim 4, wherein the separation wall is provided with a roof on a top of a first separation wall, the roof extending in a direction toward the image carrying member side over the recovery compartment.

6. The developing unit according to claim 5, wherein the recovery screw has a blade that is wound on the recovery screw, and is rotated in a rotational direction to slant the recovered developing agent in the recovery compartment to the separation wall side in the recovery compartment when the recovery screw rotates in the rotational direction.

7. The developing unit according to claim 4, wherein the recovery screw has a blade that is wound in a direction on the recovery screw, and is rotated in a rotational direction to slant the recovered developing agent in the recovery compartment to the image carrying member side in the recovery compartment when the recovery screw rotates in the another rotational direction.

8. The developing unit according to claim 1, further comprising a separation wall configured to separate the supply compartment and the agitation compartment.

9. The developing unit according to claim 1, wherein the supply screw has a uppermost point on an outer peripheral of the supply screw, the uppermost point comes below a horizontal line extended from a center of the agent carrying member, and the horizontal line and a line, extending from the center of the agent carrying member to the uppermost point of the supply screw, form an angle of 10° to 40°.

10. A developing unit developing unit for use in an image forming apparatus including an image carrying member, the developing unit comprising:

agent carrying means for carrying a two-component developing agent having a magnetic carrier and a toner thereon, and for supplying the toner to a latent image formed on the image carrying member at a position where the agent carrying means faces the image carrying member, the agent carrying means including a plurality of magnets therein to generate a magnetic flux density over the agent carrying means;

a supply compartment configured to transport the developing agent to be supplied to the agent carrying means;

supply means, included in the supply compartment, for supplying the developing agent to the agent carrying means while transporting the developing agent in a longitudinal direction of the supply compartment;

a recovery compartment, provided under the agent carrying means, configured to recover the developing agent dropped from the agent carrying means after the toner is supplied to the image carrying member from the agent carrying means;

recovery means, included in the recovery compartment, for transporting recovered developing agent in a longitudinal direction of the recovery compartment, wherein the recovery means and supply means transport the developing agent in a same direction;

an agitation compartment configured to receive the developing agent from the supply compartment, which is not supplied to the agent carrying means for developing operation and transported to a most downstream portion of the supply compartment, and the recovered developing agent from the recovery compartment, which is transported to a most downstream portion of the recovery compartment; and agitation means, included in the agitation compartment, for agitatingly transporting the developing agent in a longitudinal direction of the agitation compartment to supply agitated developing agent to the supply compartment, wherein the agitation means and supply means transport the developing agent in opposite directions to each other, wherein the recovery compartment, supply compartment, and agitation compartment are provided side-by-side in a substantially horizontal direction, and wherein the magnetic flux density on a surface of the agent carrying means in a normal line direction, extended from a center of the agent carrying means to a center of the recovery means, is set to 10 mT or less.

11. An image forming apparatus, comprising:

an image carrying member configured to form a latent image thereon;

a developing unit, comprising:

an agent carrying member configured to carry a two-component developing agent having a magnetic carrier and a toner thereon, and configured to rotate to supply the toner to a latent image formed on the image carrying member at a position where the agent carrying member faces the image carrying member, the agent carrying member including a plurality of magnets therein to generate a magnetic flux density over the agent carrying member;

a supply compartment configured to transport the developing agent to be supplied to the agent carrying member;

a supply screw, included in the supply compartment, configured to supply the developing agent to the agent carrying member while transporting the developing agent in a longitudinal direction of the supply compartment;

a recovery compartment, provided under the agent carrying member, configured to recover the developing agent dropped from the agent carrying member after the toner is supplied to the image carrying member from the agent carrying member;

a recovery screw, included in the recovery compartment, configured to transport recovered developing agent in a longitudinal direction of the recovery compartment, wherein the recovery screw and supply screw transport the developing agent in a same direction;

an agitation compartment configured to receive the developing agent from the supply compartment, which is not supplied to the agent carrying member for developing operation and transported to a most downstream portion of the supply compartment, and the recovered developing agent from the recovery compartment, which is transported to a most downstream portion of the recovery compartment; and an agitation screw, included in the agitation compartment, configured to agitatingly transport the developing agent in a longitudinal direction of the agitation compartment to supply agitated developing agent to the supply compartment, wherein the agitation screw and supply screw transport the developing agent in opposite directions to each other, wherein the recovery compartment, supply compartment, and agitation compartment are provided side-by-side in a substantially horizontal direction, and wherein the magnetic flux density on a surface of the agent carrying member in a normal line direction, extended from a center of the agent carrying member to a center of the recovery screw, is set to 10 mT or less.

12. The image forming apparatus according to claim 11, wherein the image forming apparatus includes at least two sets of the image carrying member and developing unit, wherein one of the two sets of the image carrying member and developing unit is provided with a first intermediate transfer belt, and another one of the two sets of the image carrying member and developing unit is provided with a second intermediate transfer belt, and the first intermediate transfer belt is configured to receive a first toner image from the image carrying member and to transfer the first toner image to a first face of a recording medium, and the second intermediate transfer belt is configured to receive a second toner image from the image carrying member and to transfer the second toner image to a second face of the recording medium.

* * * * *